US011680386B2

(12) United States Patent
Fukuda et al.

(10) Patent No.: US 11,680,386 B2
(45) Date of Patent: Jun. 20, 2023

(54) HYDRAULIC SYSTEM FOR WORKING MACHINE

(71) Applicant: KUBOTA CORPORATION, Osaka (JP)

(72) Inventors: Yuji Fukuda, Osaka (JP); Keigo Honda, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/539,478

(22) Filed: Dec. 1, 2021

(65) Prior Publication Data

US 2022/0090611 A1 Mar. 24, 2022

Related U.S. Application Data

(62) Division of application No. 16/366,150, filed on Mar. 27, 2019, now Pat. No. 11,215,201.

(30) Foreign Application Priority Data

Mar. 28, 2018 (JP) ..... JP2018-062416
Mar. 28, 2018 (JP) ..... JP2018-062419
Jun. 27, 2018 (JP) ..... JP2018-122398

(51) Int. Cl.
*F15B 11/16* (2006.01)
*E02F 9/22* (2006.01)
(Continued)

(52) U.S. Cl.
CPC ..... *E02F 9/2282* (2013.01); *E02F 9/2004* (2013.01); *E02F 9/2225* (2013.01);
(Continued)

(58) Field of Classification Search
None
See application file for complete search history.

(56) References Cited

U.S. PATENT DOCUMENTS 4,367,624 A * 1/1983 Ogata ..... F15B 11/17 91/509
7,174,711 B2 2/2007 Nanjo
(Continued)

FOREIGN PATENT DOCUMENTS

JP S56033371 U1 8/1981
JP S63219904 A 9/1988
(Continued)

OTHER PUBLICATIONS

JPH10168950 A machine translation to English from espacenet (Year: 1998).*

*Primary Examiner* — Kenneth Bomberg
*Assistant Examiner* — Michael Quandt
(74) *Attorney, Agent, or Firm* — Greenblum & Bernstein, P.L.C.

(57) ABSTRACT

A hydraulic system includes a hydraulic pump, a first hydraulic actuator, a second hydraulic actuator, a first control valve to control the first hydraulic actuator, a second control valve to control the second hydraulic actuator, a pressure increasing portion to increasing a pressure of the operation fluid, a first discharge fluid tube connected to any one of the first control valve and the second control valve and connected to the pressure increasing portion, a second discharge fluid tube connected to the first discharge fluid tube and configured to discharge the operation fluid, a float switching valve having an allowance position, a prevention position, and a float position, the allowance position blocking the second discharge fluid tube and allowing the operation fluid to flow to the pressure increasing portion, the prevention position unblocking the second discharge fluid tube and preventing the operation fluid from flowing to the pressure increasing portion.

7 Claims, 11 Drawing Sheets

(51) Int. Cl.
*E02F 9/20* (2006.01)
*F15B 11/044* (2006.01)

(52) U.S. Cl.
CPC ..... *E02F 9/2267* (2013.01); *E02F 9/2271* (2013.01); *F15B 11/044* (2013.01); *F15B 11/16* (2013.01); *F15B 2211/20546* (2013.01); *F15B 2211/3116* (2013.01); *F15B 2211/3133* (2013.01); *F15B 2211/46* (2013.01); *F15B 2211/50509* (2013.01); *F15B 2211/5153* (2013.01); *F15B 2211/5156* (2013.01); *F15B 2211/555* (2013.01); *F15B 2211/71* (2013.01); *F15B 2211/7741* (2013.01); *F15B 2211/88* (2013.01)

(56) References Cited

U.S. PATENT DOCUMENTS

| | | | | |
|---|---|---|---|---|
| 8,726,786 | B2 * | 5/2014 | Miki ..... | E02F 3/433 91/515 |
| 2018/0334784 | A1 | 11/2018 | Fukuda et al. | |
| 2019/0119879 | A1 | 4/2019 | Fukuda et al. | |

FOREIGN PATENT DOCUMENTS

| | | | | |
|---|---|---|---|---|
| JP | H10168950 | A | * | 6/1998 |
| JP | 2002089505 | A | | 3/2002 |
| JP | 2003120603 | A | | 4/2003 |
| JP | 2005195131 | A | | 7/2005 |
| JP | 2005291312 | A | | 10/2005 |
| JP | 2010190261 | A | | 9/2010 |
| JP | 2010270527 | | | 12/2010 |
| JP | 2012140763 | A | | 7/2012 |
| JP | 2017057925 | A | | 3/2017 |
| JP | 2017115928 | A | | 6/2017 |

* cited by examiner 16
19c(130)
19c1
75
76
24b7
20(20C)
20c1
20c3
20c2
83a
83b
18
44a
44b
44c
72
24b6
17
17
17c
17d
17a
17b
17e
22b 22a
22
20b1
43c
73c
36
20(20B)
20b2
35
20b3
81
38
34a
34b
81a
81b
43a
43b
42a
42b
42c
24b4
14
14b
14a
14e
14
14c
14d
29a
51
120
85
63
24b5
21b 21a
21
20a1
20a3
31
121
41c
20a2
61
24b1
20(20A)
53c
32
61a
151
37
150
86
122
110
123b
33a
33b
41b
41a
46b
46c
46a
61b
27a
123
123a
25
24a
24b3
24b2
24b
28a
28
(130)
P1
27
E
28b
P2
7
15

Hydraulic actuator
16
75
76
113
24b7
20(20C)
20c1
20c3
20c2
83a
83b
18
44a
44b
44c
72
17
17
17c
17d
17a
17b
17e
22b 22a
22
20b1
43c
73c
36
20(20B)
20b2
35
20b3
81
38
34a
34b
81a
81b
43a
43b
42a
42b
42c
24b4
14
14b
14a
14e
14
14c
14d
29a
85
51
120
63
121
24b5
21b 21a
21
20a1
20a3
31
41c
20a2
20(20A)
53c
32
61a
151
61
24b1
37
37
86
24b6
7
27
P1
E
P2
123b
33a
41a
46a
110
150
122
33b
41b
46b
46c
61b
169b
169a
24b2
301
123a
280
123
25
24b3
280a
26c
270
233
231
232
24a
27a
15
237
268c
114
268
24b
165
181
182
166
167
501
Control device
268d
268b
238
236
234
235
268a
280b
280
169c
135
130a
130
131
15
130b 16
76
75
113
24b7
20(20C)
20c1
20c3
20c2
83a
83b
18
44a
44b
44c
72
17
17
17c
17d
17a
17b
17e
22b 22a
22
20b1
43c
73c
36
20(20B)
20b2
35
20b3
81
38
34a
34b
81a
43a
43b
42a
42b
42c
81b
24b4
14
14b
14a
14e
14
14c
14d
29a
51
120
85
26b
24b5
63
21b 21a
21
20a1
20a3
31
121
41c
20a2
20(20A)
53c
32
61a
151
61
24b1
37
150
86
122
110
33b
41b
46b
46c
33a
41a
46a
123b
165
166
24b6
114
61b
26a
27a
123
123a
25
24a
24b2
24b3
24b
26c
160
140
130a
130
131
130b
27
E
P2
P1
160a
160b
7
15
135

HYDRAULIC SYSTEM FOR WORKING MACHINE

CROSS-REFERENCE TO RELATED APPLICATIONS

The present application is a divisional application of the U.S. patent application Ser. No. 16/366,150 filed on Mar. 27, 2019, which claims priority under 35 U.S.C. § 119 to Japanese Patent Application No. 2018-062416, filed Mar. 28, 2018, to Japanese Patent Application No. 2018-062419, filed Mar. 28, 2018, and to Japanese Patent Application No. 2018-122398, filed Jun. 27, 2018. The contents of these applications are incorporated herein by reference in their entirety.

BACKGROUND OF THE INVENTION

Field of the Invention

The present invention relates to a hydraulic system for a working machine and to a control valve.

Description of Related Art

A hydraulic system for a working machine disclosed in Japanese Patent Application Publication No. 2010-270527 is conventionally known. The working machine disclosed in Japanese Patent Application Publication No. 2010-270527 includes a boom, a bucket, a boom cylinder to move the boom, a bucket cylinder to move the bucket, an auxiliary actuator to actuate an auxiliary attachment, a first control valve to control stretching and shortening of the boom cylinder, a second control valve to control stretching and shortening of the bucket cylinder, and a third control valve to actuate the auxiliary actuator.

SUMMARY OF THE INVENTION

A hydraulic system for a working machine, includes a hydraulic pump to output an operation fluid, a first hydraulic actuator, a second hydraulic actuator, a first control valve to control the first hydraulic actuator, a second control valve to control the second hydraulic actuator, the second control valve being arranged on a downstream side of the first control valve, a pressure increasing portion to increasing a pressure of the operation fluid, a first discharge fluid tube connected to any one of the first control valve and the second control valve and connected to the pressure increasing portion, a second discharge fluid tube connected to the first discharge fluid tube and configured to discharge the operation fluid separately from the first discharge fluid tube, a float switching valve having an allowance position, a prevention position, and a float position, the allowance position blocking the second discharge fluid tube and allowing the operation fluid to flow to the pressure increasing portion, the prevention position unblocking the second discharge fluid tube and preventing the operation fluid from flowing to the pressure increasing portion, the float position allowing the operation fluid of the first hydraulic actuator to be discharged from a third discharge fluid tube other than the first discharge fluid tube and the second discharge fluid tube.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
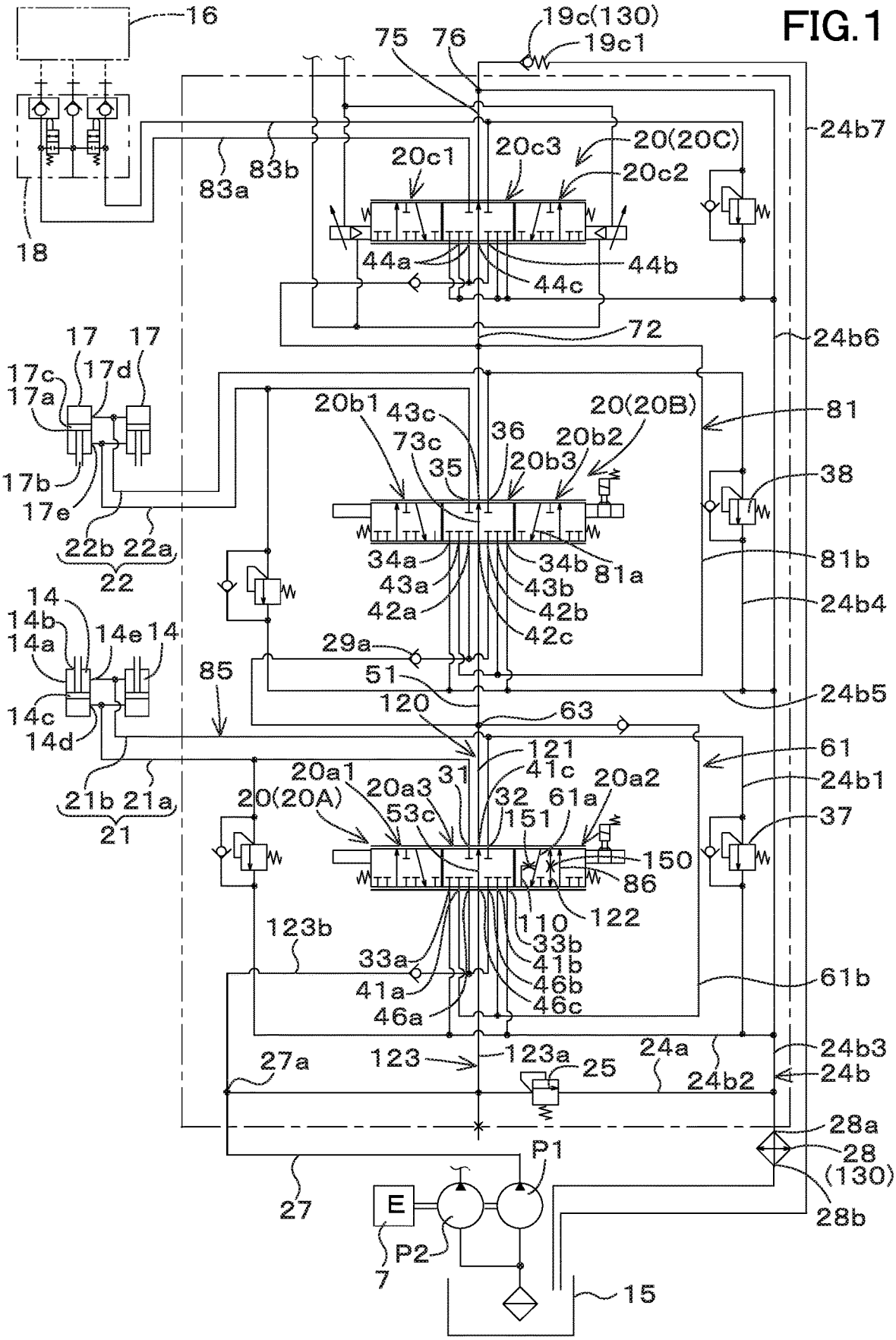
FIG. 1 is a view illustrating a hydraulic system (hydraulic circuit) for a working machine according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described below with reference to the drawings as appropriate.

Specifically, embodiments of a hydraulic system for a working machine according to the present invention and of the working machine having the hydraulic system will be described below with reference to the drawings as appropriate.

First Embodiment

Figure 10:
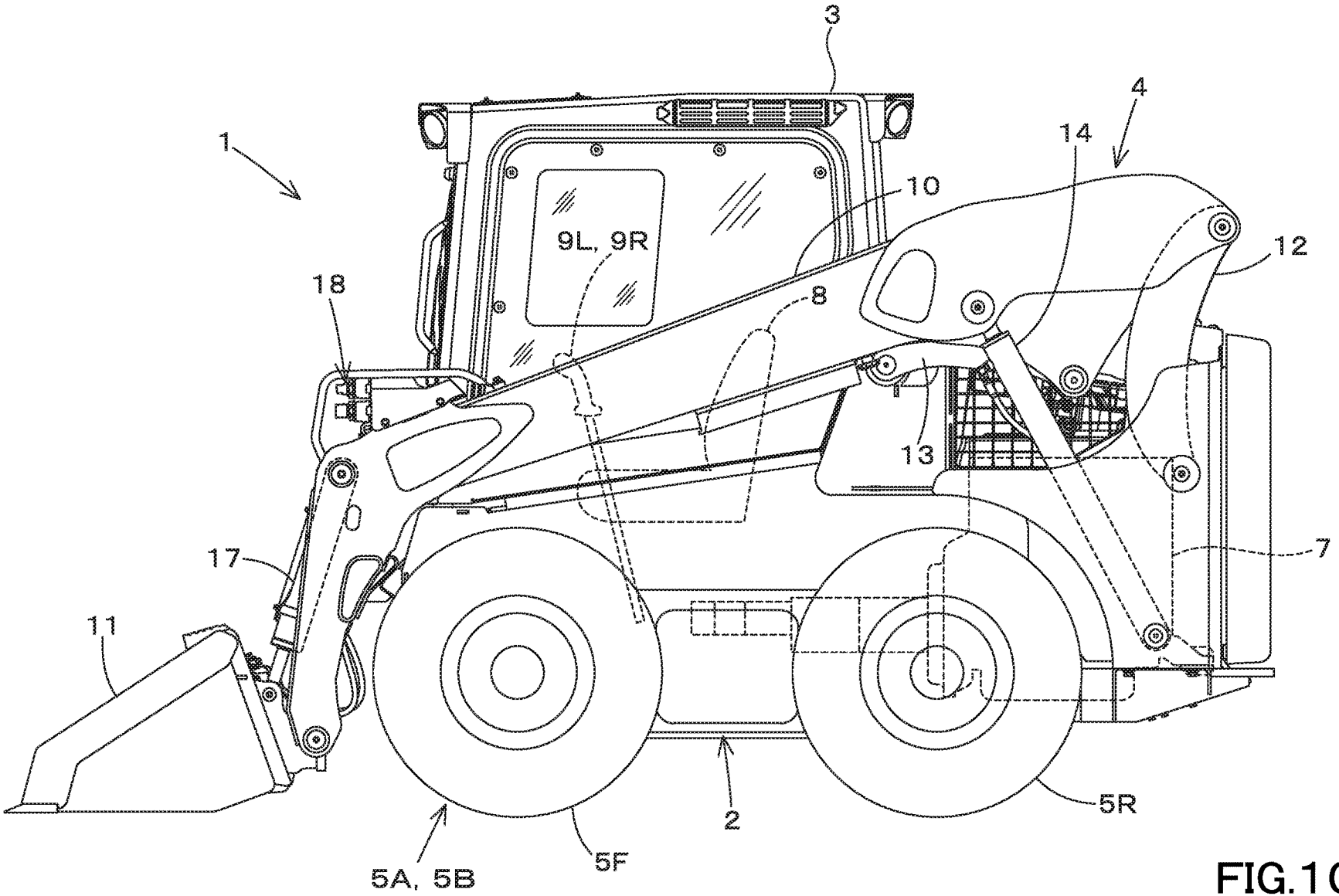
FIG. 10 is a whole view of a skid steer loader exemplified as the working machine according to the embodiment.

Firstly, the working machine will be explained. FIG. 10 shows a side view of the working machine according to the present invention. In FIG. 10, a skid steer loader is shown as an example of the working machine.

However, the working machine according to the present invention is not limited to the skid steer loader. For example, the working machine may be another type of loader working machine such as a compact track loader. In addition, the working machine may be another working machine other than the loader working machine.

The working machine 1 includes a machine body (vehicle body) 2, a cabin 3, a working device 4, and traveling devices 5A and 5B.

A cabin 3 is mounted on the machine body 2. An operator seat 8 is provided at a rear portion of an inside of the cabin 3. In the embodiment of the present invention, the front side of the operator seated on the operator seat 8 of the working machine 1 (the left side in FIG. 10) is referred to as the front. The rear side of the operator (the right side in FIG. 10) is referred to as the rear. The left side of the operator (a front surface side of FIG. 10) is referred to as the left. The right side of the operator (a back surface side of FIG. 10) is referred to as the right.

In addition, a horizontal direction which is a direction orthogonal to the front-to-rear direction will be referred to as a machine width direction. And, a direction from the center portion of the machine body 2 to the right portion or the left portion will be referred to as a machine outward direction. In other words, the machine outward direction is the machine width direction separating from the machine body 2.

In the explanation, a direction opposite to the machine outward direction is referred to as a machine inward direction. In other words, the machine inward direction is the machine width direction approaching the machine body 2.

The cabin 3 is mounted on the machine body 2. The working device 4 is an apparatus that performs the work and is mounted on the machine body 2. The traveling device 5A is a device for the traveling of the machine body 2, and is provided on the left side of the machine body 2. The traveling device 5B is a device for the traveling of the machine body 2, and is provided on the right side of the machine body 2.

A prime mover 7 is provided at the rear portion of the inside of the machine body 2. The prime mover 7 is an engine (diesel engine). It should be noted that the prime mover 7 is not limited to the engine, and may be an electric motor or the like.

A traveling lever 9L is provided on the left side of the operator seat 8. A traveling lever 9R is provided on the right side of the operator seat 8. The traveling lever 9L provided on the left is for operating the travel device 5A provided on the left, and the traveling lever 9R provided on the right is for operating the travel device 5B provided on the right.

The working device 4 includes a boom 10, a bucket 11, a lift link 12, a control link 13, a boom cylinder 14, and a bucket cylinder 17. The boom 10 is provided on the side of the machine body 2.

The bucket 11 is provided at the tip end (front end) of the boom 10. The lift link 12 and the control link 13 support the base portion (rear portion) of the boom 10. The boom cylinder 14 moves the boom 10 upward and downward.

In particular, the lift link 12, the control link 13 and the boom cylinder 14 are provided on the side of the machine body 2. An upper portion of the lift link 12 is pivotally supported on an upper portion of the base portion of the boom 10. A lower portion of the lift link 12 is pivotally supported on the side portion of the rear portion of the machine body 2.

The control link 13 is arranged in front of the lift link 12. One end of the control link 13 is pivotally supported at a lower portion of a base portion of the boom 10, and the other end is pivotally supported by the machine body 2.

The boom cylinder 14 is a hydraulic cylinder configured to move the boom 10 upward and downward. The upper portion of the boom cylinder 14 is pivotally supported on the front portion of the base portion of the boom 10. The lower portion of the boom cylinder 14 is pivotally supported on the side portion of the rear portion of the machine body 2. When the boom cylinder 14 is stretched and shortened, the lift link 12 and the control link 13 swing the boom 10 upward and downward.

The bucket cylinder 17 is a hydraulic cylinder configured to swing the bucket 11. The bucket cylinder 17 couples between the left portion of the bucket 11 and the boom provided on the left, and couples between the right portion of the bucket 11 and the boom provided on the right.

In addition, in place of the bucket 11, an auxiliary attachment such as a hydraulic crusher, a hydraulic breaker, an angle broom, an auger, a pallet fork, a sweeper, a mower, a snow blower or the like can be attached to the tip end (front portion) of the boom 10.

In the present embodiment, wheel-type traveling devices 5A and 5B each having the front wheels 5F and the rear wheels 5R are adopted as the traveling devices 5A and 5B. Meanwhile, crawler type traveling devices 5A and 5B (including semi-crawler type traveling devices 5A and 5B) may be adopted as the traveling devices 5A and 5B.

Next, a working hydraulic circuit (working hydraulic system) provided in the skid steer loader 1 will be described below.

The working hydraulic system is a system configured to operate the boom 10, the bucket 11, the auxiliary attachment and the like. As shown in FIG. 1, the working hydraulic system includes a plurality of control valves 20 and a working hydraulic pump (first hydraulic pump) P1. In addition, the working hydraulic system is provided with a second hydraulic pump P2 other than the first hydraulic pump P1.

The first hydraulic pump P1 is a pump configured to be operated by the power of the prime mover 7. The first hydraulic pump P1 is constituted of a constant displacement type gear pump. The first hydraulic pump P1 is configured to output the operation fluid stored in a tank (operation fluid tank) 15.

The second hydraulic pump P2 is a pump configured to be operated by the power of the prime mover 7. The second hydraulic pump P2 is constituted of a constant displacement type gear pump. The second hydraulic pump P2 is configured to output the operation fluid stored in the tank (operation fluid tank) 15.

In the hydraulic system, the second hydraulic pump P2 outputs the operation fluid for signals and the operation fluid for controls. The operation fluid for signals and the operation fluid for controls are referred to as a pilot fluid.

The plurality of control valves 20 are valves configured to control various types of hydraulic actuators provided in the working machine 1. The hydraulic actuator is a device configured to be operated by the operation fluid, and is constituted of a hydraulic cylinder, a hydraulic motor, or the like. In the embodiment, the plurality of control valves 20 include a boom control valve 20A, a bucket control valve 20B, and an auxiliary control valve 20C.

The boom control valve 20A is a valve configured to control the hydraulic actuator (boom cylinder) 14 that moves the boom 10. The boom control valve 20A is constituted of a direct-acting spool type three-position switching valve (a direct-acting spool type three-position switching valve).

The boom control valve 20A is configured to be switched to a neutral position 20*a*3, to a first position 20*a*1 other than the neutral position 20*a*3, and to a second position 20*a*2 other than the neutral position 20*a*3 and the first position 20*a*1.

In the boom control valve 20A, the switching between the neutral position 20*a*3, the first position 20*a*1, and the second position 20*a*2 is performed by moving the spool through operation of the operation member.

Meanwhile, the switching of the boom control valve 20A is performed by directly moving the spool through manual operation of the operation member. However, the spool may be moved by the hydraulic operation (hydraulic operation by a pilot valve, and hydraulic operation by a proportional valve).

In addition, the spool may be moved by the electric operation (electric operation by exciting the solenoid). In addition, the spool may be moved by other methods.

The boom control valve 20A and the first hydraulic pump P1 are coupled by an output fluid tube 27. A discharge fluid tube 24*a* connected to the operation fluid tank 15 is connected to a section between the boom control valve 20A and the first hydraulic pump P1.

A relief valve (main relief valve) 25 is provided to an intermediate portion of the discharge fluid tube 24*a*. The operation fluid outputted from the first hydraulic pump P1 passes through the output fluid tube 27 and is supplied to the boom control valve 20A. In addition, the boom control valve 20A and the boom cylinder 14 are coupled to each other by a fluid tube 21.

In particular, the boom cylinder 14 includes a cylindrical body 14*a*, a rod 14*b* movably provided on the cylindrical body 14*a*, and a piston 14*c* provided on the rod 14*b*.

A first port 14*d* for supplying and discharging the operation fluid is provided on the base end portion of the cylindrical body 14*a* (on the side opposite to the rod 14*b* side). A second port 14*e* for supplying and discharging the operation fluid is provided on the tip end of the cylindrical body 14*a* (on the side of the rod 14*b*).

The fluid tube 21 includes a communication fluid tube 21*a* and a communication fluid tube 21*b*. The communication fluid tube 21*a* couples the first port 31 of the boom control valve 20A to the first port 14*d* of the boom cylinder 14. The communication fluid tube 21*b* couples the second port 32 of the boom control valve 20A to the second port 14*e* of the boom cylinder 14.

Thus, when the boom control valve 20A is set to the first position 20*a*1, the operation fluid can be supplied from the communication fluid tube 21*a* to the first port 14*d* of the boom cylinder 14, and further the operation fluid can be discharged from the second port 14*e* of the boom cylinder 14 to the communication fluid tube 21*b*. In this manner, the boom cylinder 14 is stretched, and thereby the boom 10 moves upward.

When the boom control valve 20A is set to the second position 20*a*2, the operation fluid can be supplied from the communication fluid tube 21*b* to the second port 14*e* of the boom cylinder 14, and further the operation fluid can be discharged from the first port 14*d* of the boom cylinder 14 to the communication fluid tube 21*a*. In this manner, the boom cylinder 14 is shortened, and thereby the boom 10 moves downward.

The bucket control valve 20B is a valve configured to control the hydraulic cylinder (bucket cylinder) 17 that controls the movement of the bucket 11. The bucket control valve 20B is a three-position switching valve of pilot-actuated direct-acting spool type (a three-position switching valve of pilot-actuated direct-acting spool type).

The bucket control valve 20B is configured to be switched to a neutral position 20*b*3, to a first position 20*b*1 other than the neutral position 20*b*3, and to a second position 20*b*2 other than the neutral position 20*b*3 and the first position 20*b*1. In the bucket control valve 20B, the switching between the neutral position 20*b*3, the first position 20*b*1, and the second position 20*b*2 is performed by moving the spool through operation of the operation member.

Meanwhile, the switching of the bucket control valve 20B is performed by directly moving the spool through manual operation of the operation member. However, the spool may be moved by the hydraulic operation (hydraulic operation by a pilot valve, and hydraulic operation by a proportional valve). In addition, the spool may be moved by the electric operation (electric operation by exciting the solenoid). In addition, the spool may be moved by other methods.

The bucket control valve 20B and the bucket cylinder 17 are coupled by a fluid tube 22. More specifically, the bucket cylinder 17 includes a cylindrical body 17*a*, a rod 17*b* movably provided on the cylindrical body 17*a*, and a piston 17*c* provided on the rod 17*b*.

A first port 17*d* for supplying and discharging the operation fluid is provided on the base end portion (the side opposite to the rod 17*b* side) of the cylindrical body 17*a*. A second port 17*e* for supplying and discharging the operation fluid is provided on the tip end (the side of the rod 17*b*) of the cylindrical body 17*a*.

The fluid tube 22 includes a communication fluid tube 22*a* and a communication fluid tube 22*b*. The communication fluid tube 22*a* couples the first port 35 of the bucket control valve 20B to the second port 17*e* of the bucket cylinder 17. The communication fluid tube 22*b* couples the second port 36 of the bucket control valve 20B to the first port 17*d* of the bucket cylinder 17.

Thus, when the bucket control valve 20B is set to the first position (first operational position) 20*b*1, the operation fluid can be supplied from the communication fluid tube 22*a* to the second port 17*e* of the bucket cylinder 17, and further the operation fluid can be discharged from the first port 17*d* of the bucket cylinder 17 to the communication fluid tube 22*b*.

In this manner, the bucket cylinder 17 is shortened, and thereby the bucket 11 performs the shoveling operation. When the bucket control valve 20B is set to the second position 20*b*2, the operation fluid can be supplied from the communication fluid tube 22*b* to the first port 17*d* of the bucket cylinder 17, and further the operation fluid can be discharged from the second port 17*e* of the bucket cylinder 17 to the communication fluid tube 22*a*. In this manner, the bucket cylinder 17 is stretched, and thereby the bucket 11 performs the dumping operation.

The auxiliary control valve 20C is a valve configured to control the hydraulic actuator (hydraulic cylinder, hydraulic motor, and the like) 16 attached to the auxiliary attachment. The auxiliary control valve 20C is a three-position switching valve of pilot-actuated direct-acting spool type (a three-position switching valve of pilot-actuated direct-acting spool type).

The auxiliary control valve 20C is configured to be switched to a neutral position 20*c*3, to a first position 20*c*1 other than the neutral position 20*c*3, and to a second position 20*c*2 other than the neutral position 20*c*3 and the first position 20*c*1. In the auxiliary control valve 20C, the switching between the neutral position 20*c*3, the first position 20*c*1, and the second position 20*c*2 is performed by moving the spool with use of a pressure of the pilot fluid.

A coupling member 18 is connected to the auxiliary control valve 20C via supplying-discharging fluid tubes 83*a* and 83*b*. A fluid tube connected to the hydraulic actuator 16 of the auxiliary attachment is connected to the coupling member 18.

Thus, when the auxiliary control valve 20C is set to the first position 20*c*1, the operation fluid can be supplied from the supplying-discharging fluid tube 83*a* to the hydraulic actuator 16 of the auxiliary attachment. When the auxiliary control valve 20C is set to the second position 20*c*2, the operation fluid can be supplied from the supplying-discharging fluid tube 83*b* to the hydraulic actuator 16 of the auxiliary attachment.

In this manner, when the operation fluid is supplied to the hydraulic actuator 16 from the supplying-discharging fluid tube 83*a* or the supplying-discharging fluid tube 83*b*, the hydraulic actuator 16 (the auxiliary attachment) can be operated.

The series circuit (series fluid tube) is employed in the hydraulic system. In the series circuit, the operation fluid returned from the hydraulic actuator to the control valve arranged on the upstream side can be supplied to the control valve arranged on the downstream side.

For example, focusing on the bucket control valve 20B and the auxiliary control valve 20C, the bucket control valve 20B is the control valve arranged on the upstream side, and the auxiliary control valve 20C is the control valve arranged on the downstream side.

Hereinafter, the control valve arranged on the upstream side is referred to as a "first control valve", and the control valve arranged on the downstream side is referred to as a "second control valve". A control valve other than the first control valve and the second control valve and provided on the upstream side upper from the second control valve is referred to as a "third control valve".

In addition, the hydraulic actuator corresponding to the first control valve is referred to as a "first hydraulic actuator". The hydraulic actuator corresponding to the second control valve is referred to as a "second hydraulic actuator". The hydraulic actuator corresponding to the third control valve is referred to as a "third hydraulic actuator".

The fluid tube for supplying the return fluid to the second control valve is referred to as a "first fluid tube", the return fluid being the operation fluid returning from the first hydraulic actuator to the first control valve.

In the embodiment, the bucket control valve 20B corresponds to the "first control valve". The auxiliary control valve 20C corresponds to the "second control valve". The boom control valve 20A corresponds to the "third control valve". In addition, the bucket cylinder 17 corresponds to the "first hydraulic actuator". The hydraulic actuator 16 of the auxiliary attachment corresponds to the "second hydraulic actuator". The boom cylinder 14 corresponds to the "third hydraulic actuator".

Hereinafter, the relationship between the first control valve 20A and the second control valve 20B will be described in detail.

The first control valve 20A and an output portion of the first hydraulic pump P1 are coupled to each other by an output fluid tube 27. The output fluid tube 27 is branched at an intermediate portion 27*a*. The branched fluid tube of the output fluid tube 27 is connected to the first input port 46*a* and the second input port 46*b* of the first control valve 20A.

In addition, the output fluid tube 27 is connected to the third input port 46*c* of the first control valve 20A. Thus, the operation fluid outputted from the first hydraulic pump P1 can be supplied to the first control valve 20A through the output fluid tube 27, the first input port 46*a*, the second input port 46*b*, and the third input port 46*c*.

The first control valve 20A and the second control valve 20B are coupled by a central fluid tube 51. The central fluid tube 51 couples the third output port 41*c* of the first control valve 20A to the third input port 42*c* of the second control valve 20B.

When the first control valve 20A is set to the neutral position 20*a*3, the supply fluid, which is the operation fluid supplied from the output fluid tube 27 to the first control valve 20A, is supplied to the central fluid tube 51 through the first control valve 20A by the communication of the central fluid tube 53*c* coupling the third input port 46*c* to the third output port 41*c*.

The first control valve 20A and the second control valve 20B are coupled by a first fluid tube 61 separately from the central fluid tube 51. The first fluid tube 61 is a fluid tube that supplies, to the second control valve 20B through the first control valve 20A, the return fluid returning from the first hydraulic actuator 14 to the first control valve 20A.

The first fluid tube 61 includes a communication fluid tube (first coupling fluid tube) 21*a*, a first inner fluid tube 61*a*, and an outer fluid tube 61*b*. The first coupling fluid tube 21*a* is a fluid tube coupling the first port 31 of the first control valve 20A to the first port 14*d* of the first hydraulic actuator 14, and is a fluid tube in which the return fluid discharged from the first port 14*d* of the first hydraulic actuator 14 flows.

The first inner fluid tube 61*a* is a fluid tube that is provided in the first control valve 20A and is communicated with the first coupling fluid tube 21*a*. More specifically, the first inner fluid tube 61*a* is a fluid tube that couples the first port 31 of the first control valve 20A to the first output port 41*a* of the first control valve 20A when the first control valve 20A is set to the second position 20*a*2.

The outer fluid tube 61*b* is a fluid tube that is communicated with the first inner fluid tube 61*a* and is connected to the second control valve 20B. The outer fluid tube 61*b* couples the first output port 41*a* of the first control valve 20A to the first input port 42*a* of the second control valve 20B, and couples the second output port 41*b* of the first control valve 20 to the second input port 42*b* of the second control valve 20B.

An intermediate portion of the communication fluid tube 61*b* is connected to the central fluid tube 51. That is, the outer fluid tube 61*b* and the central fluid tube 51 are jointed in the middle with each other.

According to the above configuration, when the first control valve 20A is set to the second position 20*a*2 which is the lateral position, the supply fluid introduced to the second input port 46*b* passes through the second port 32 and the communication fluid tube 21*b* and enters the second port 14*e* of the first hydraulic actuator 14. When the supply fluid is supplied to the second port 14*e*, the first hydraulic actuator 14 is shortened, for example.

When the first hydraulic actuator 14 is shortened, the return fluid discharged from the first port 14*d* of the first hydraulic actuator 14 passes through the first coupling fluid tube 21*a* and flows into the first inner fluid tube 61*a*. The return fluid of the first inner fluid tube 61*a* flows through the outer fluid tube 61*b* and flows toward the second control valve 20B. Thus, the return fluid of the first hydraulic actuator 14 can be supplied to the second control valve 20B.

Next, the relationship between the second control valve 20B and the third control valve 20C will be described in detail.

The second control valve 20B and the third control valve 20C are coupled by the central fluid tube 72. The central fluid tube 72 couples the third output port 43*c* of the second control valve 20B to the third input port 44*c* of the third control valve 20C.

Thus, when the second control valve 20B is set to the neutral position 20*b*3, the supply fluid, which is the operation fluid supplied to the second control valve 20B, flows through the central fluid tube 73*c* coupling the third input port 42*c* to the third output port 43*c*, and is supplied to the central fluid tube 72 connected to the third output port 43*c*.

The second control valve 20B and the third control valve 20C are coupled by a fluid tube 81 separately from the central fluid tube 72. The fluid tube 81 is a fluid tube that supplies, to the third control valve 20C through the second control valve 20B, the return fluid returning from the second hydraulic actuator 17 to the second control valve 20B.

The fluid tube 81 includes a communication fluid tube 22*a*, a communication fluid tube 81*a*, and a communication fluid tube 81*b*. The communication fluid tube 22*a* is a fluid tube coupling the first port 35 of the second control valve 20B to the second port 17*e* of the second hydraulic actuator 17, and is a fluid tube in which the return fluid discharged from the second port 17*e* flows.

The communication fluid tube 81*a* is a fluid tube that is provided in the second control valve 20B and is communicated with the communication fluid tube 22*a*. More specifically, the communication fluid tube 81*a* is a fluid tube that couples the first port 35 of the second control valve 20B to the first output port 43*a* of the second control valve 20B when the second control valve 20B is set to the second position 20*b*2.

The communication fluid tube 81*b* is a fluid tube that is communicated with the communication fluid tube 81*a* and is connected to the third control valve 20C. The communication fluid tube 81*b* couples the first output port 43*a* of the second control valve 20B to the first input port 44*a* of the third control valve 20C, and couples the second output port 43*b* of the second control valve 20B to the second input port 44*b* of the third control valve 20C. An intermediate portion of the communication fluid tube 81*b* is connected to the central fluid tube 72.

According to the above configuration, when the second control valve 20B is set to the second position 20*b*2 which is the lateral position, the supply fluid introduced into the second input port 42*b* passes through the second port 36 and the communication fluid tube 22*b*, and enters the first port 17*d* of the second hydraulic actuator 17. When the supply fluid is supplied to the first port 17*d*, the second hydraulic actuator 17 is stretched, for example.

When the second hydraulic actuator 17 is stretched, the return fluid discharged from the second port 17*e* of the second hydraulic actuator 17 passes through the communication fluid tube 22*a* and flows to the communication fluid tube 81*a*, and the return fluid from the communication fluid tube 81*a* passes through the communication fluid tube 81*b* and flows toward the third control valve 20C. Thus, the return fluid from the second hydraulic actuator 17 can be supplied to the third control valve 20C.

The hydraulic system for the working machine includes a discharge fluid tube 24*b* configured to discharge the operation fluid to the operation fluid tank 15 and the like. The discharge fluid tube 24*b* includes a fluid tube 24*b*1, a fluid tube 24*b*2, and a fluid tube 24*b*3.

The fluid tube 24*b*1 is a fluid tube connected to the communication fluid tube 21*b*. A relief valve 37 is provided in the middle of the fluid tube 24*b*1. The fluid tube 24*b*2 is a fluid tube connected to the first coupling fluid tube 21*a* and to the first discharge port 33*a* and the second discharge port 33*b* of the first control valve 20A. The fluid tube 24*b*3 is a fluid tube that couples the confluent portion between the fluid tube 24*b*1 and the fluid tube 24*b*2 to the operation fluid tank 15.

Further, the discharge fluid tube 24*b* includes the fluid tube 24*b*4, the fluid tube 24*b*5, the fluid tube 24*b*6, and the fluid tube 24*b*7.

The fluid tube 24*b*4 is a fluid tube connected to the communication fluid tube 22*b*. A relief valve 38 is provided in the middle of the fluid tube 24*b*1. The fluid tube 24*b*5 is a fluid tube connected to the communication fluid tube 22*a* and to the first discharge port 34*a* and the second discharge port 34*b* of the second control valve 20B. The fluid tube 24*b*6 couples the fluid tube 24*b*3 to the confluent portion between the fluid tube 24*b*1 and the fluid tube 24*b*2.

The fluid tube 24*b*6 is communicated with a central fluid tube 75 that is communicated with the central fluid tube 72. The fluid tube 24*b*7 couples the operation fluid tank 15 and the like to the confluent portion 76 at which the fluid tube 24*b*6 and the central fluid tube 75 are connected to each other.

Figure 2:
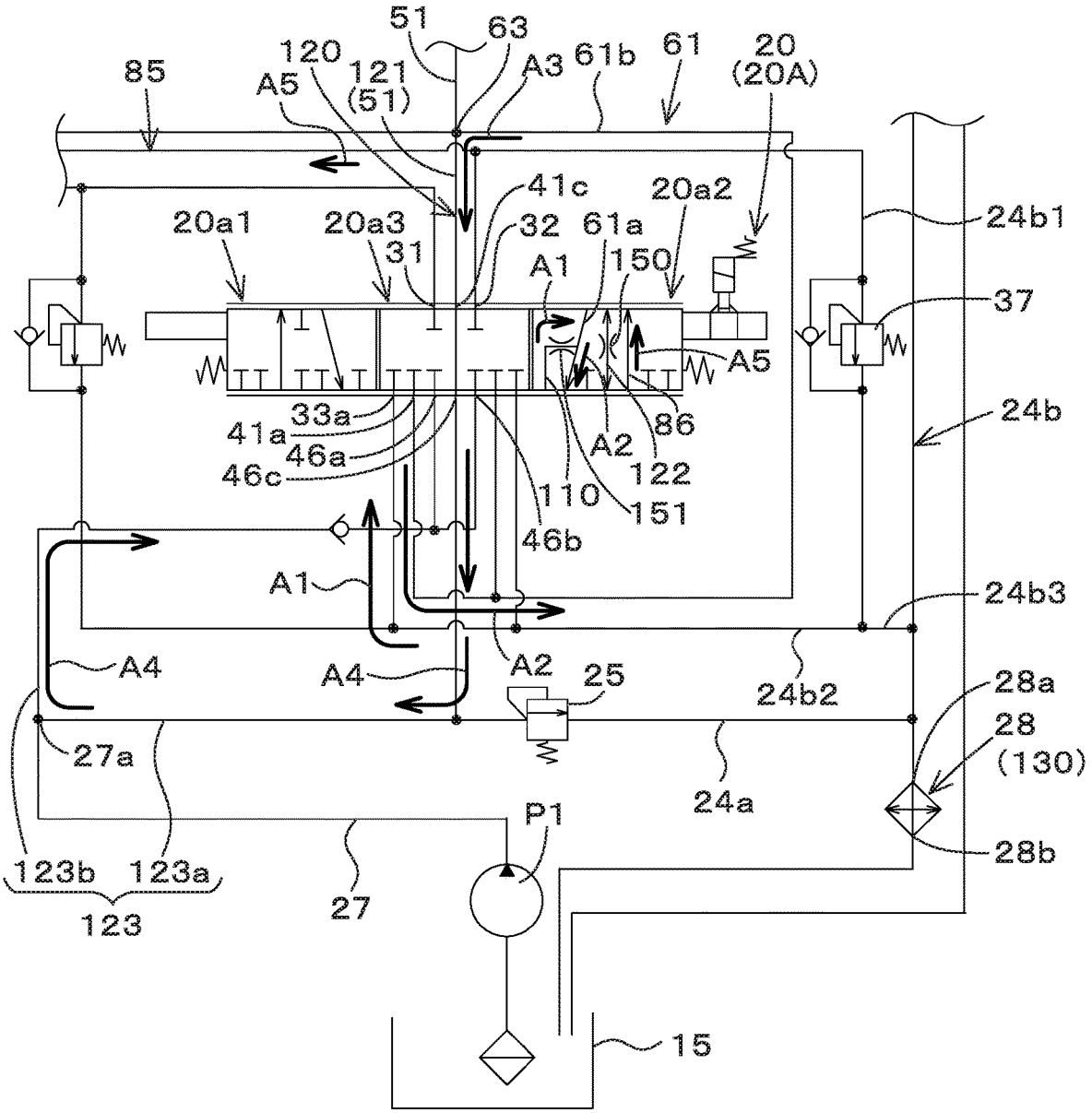
FIG. 2 is an explanation view explaining flowing of an operation fluid according to the first embodiment.

As shown in FIG. 1 and FIG. 2, the hydraulic system for the working machine includes a third fluid tube 110, a fourth fluid tube 120, and a pressure increasing portion 130. The third fluid tube 110 is a fluid tube connected to the first fluid tube 61. The third fluid tube 110 is provided in the first control valve 20A, and couples the discharge fluid tube 24*b* to the first inner fluid tube 61*a* of the first fluid tube 61.

Specifically, the third fluid tube 110 couples the first inner fluid tube 61*a* to the first discharge port 33*a* (discharge fluid tube 24*b*) when the first control valve 20 is set to the second position 20*a*2. The third fluid tube 110 may be provided with a throttle portion 151 configured to reduce the flow rate of the operation fluid.

The fourth fluid tube 120 is a fluid tube that is connected to the first fluid tube 61 and supplies, to the second fluid tube 85, the return fluid from the first fluid tube 61. The second fluid tube 85 includes a communication fluid tube (second coupling fluid tube) 21*b* and a second inner fluid tube 86.

The communication fluid tube 21*b* is a fluid tube that couples the second port 32 of the first control valve 20A to the second port 14*e* of the first hydraulic actuator 14, and is a fluid tube that supplies, to the second port 14*e*, the supply fluid flowing in the second port 32. The second inner fluid tube 86 is a fluid tube provided in the first control valve 20A and communicated with the communication fluid tube 21*b*.

More specifically, the second inner fluid tube 86 is a fluid tube that couples the second input port 46*b* of the first control valve 20A to the second port 32 of the first control valve 20A when the first control valve 20A is set to the second position 20*a*2.

The fourth fluid tube 120 includes a coupling fluid tube 121, a third inner fluid tube 122, and a return fluid tube 123. The coupling fluid tube 121 is a fluid tube other than the first fluid tube 61 and is a fluid tube that couples the first control valve 20A to the outer fluid tube 61*b* of the first fluid tube 61.

Specifically, the coupling fluid tube 121 is a part of the central fluid tube 51, and is a fluid tube that couples the confluent portion 63 to the third output port 41*c* of the first control valve 20A. The third inner fluid tube 122 is a fluid tube that couples the third output port 41*c* of the first control valve 20A to the third input port 46*c* of the first control valve 20A when the first control valve 20A is set to the second position 20*a*2. The third inner fluid tube 122 may be provided with the throttle portion 150 configured to reduce the flow rate of the operation fluid.

The return fluid tube 123 is a return fluid tube that is communicated with the third inner fluid tube 122 and returns, to the first control valve 20A, the operation fluid having passed through the coupling fluid tube 121 and the third inner fluid tube 122. The return fluid tube 123 is a part of the output fluid tube 27, and includes the section fluid tube 123*a* of the output fluid tube 27 and the section fluid tube 123*b* of the output fluid tube 27.

The section fluid tube 123*a* is a fluid tube coupling the third output port 41*c* to the intermediate portion 27*a*. The section fluid tube 123*b* is a fluid tube coupling the intermediate portion 27*a* to the second input port 46*b*.

The pressure increasing portion 130 is a portion connected to the discharge fluid tube 24*b* and configured to increase the pressure in the discharge fluid tube 24*b*. The pressure increasing portion 130 is constituted of a check valve 19*c*, an oil cooler 28, and the like provided in the discharge fluid tube 24*b*.

In particular, the check valve 19 *c* is connected to an intermediate portion of the fluid tube 24*b*7 of the discharge fluid tube 24*b*. The check valve 19*c* is a valve that allows the operation fluid to flow toward the operation fluid tank 15 and prevents the operation fluid from flowing toward the central fluid tube 75. The check valve 19*c* has a setting member 19*c*1 configured to set a differential pressure.

The setting member 19*c*1 is constituted of a spring or the like, and generates the differential pressure by pushing the valve body with a predetermined pushing force from a direction (preventing direction) opposed to the direction allowing the flow of the operation fluid.

The oil cooler 28 is provided in the middle of the discharge fluid tube 24*b*. The operation fluid discharged from the discharge fluid tube 24*b*3 flows into the inflow port 28*a* of the oil cooler 28. The discharge port 28*b*, which is different from the inflow port 28*a* of the oil cooler 28, is connected to the operation fluid tank 15.

According to the above configuration, when the first control valve 20 A is set to the second position 20*a*2, the operation fluid from the discharge fluid tube 24*b* passes through the first discharge port 33*a* and flows into the third fluid tube 110 as indicated by an arrowed line A1 in FIG. 2 when the pressure increasing portion 130 causes the pressure of the operation fluid in the discharge fluid tube 24*b* to be higher than the pressure of the operation fluid in the third fluid tube 110.

As indicated by an arrowed line A2 in FIG. 2, the operation fluid (reverse flow fluid) backwardly flown to the third fluid tube 110 and the return fluid flowing through the first inner fluid tube 61*a* communicated with the third fluid tube 110 both pass through the inner fluid tube 61*a* and the first output port 41*a*, and flow to the outer fluid tube 61*b*.

As indicated by an arrowed line A3 in FIG. 2, a part of the operation fluid in the outer fluid tube 61*b* flows through the confluent portion 63, flows through the coupling fluid tube 121 and the third inner fluid tube 122, and then is discharged from the third input port 46*c*.

In addition, as indicated by an arrowed line A4 in FIG. 2, the operation fluid discharged from the third input port 46*c* passes through the return fluid tube 123, returns to the first control valve 20A again, and then enters the second input port 46*b* of the first control valve 20A.

As indicated by an arrowed line A5 in FIG. 2, the operation fluid that has entered the second input port 46*b* of the first control valve 20A flows through the second inner fluid tube 86 of the second fluid tube 85, and then flows into the communication fluid tube 21*b* of the second fluid tube 85.

That is, as indicated by the arrowed lines A1 to A5 in FIG. 2, it is possible to reverse the operation fluid in the discharge fluid tube 24*b* and supply the reversed operation fluid or the like to the communication fluid tube 21*b* through which the supply fluid flows. In other words, the first control valve 20A receives the return fluid from the first hydraulic actuator 14 and the operation fluid (reversed fluid) from the discharge fluid tube 24, and is configured to be switched between a position (second position) 20*a*2 allowing the received operation fluid (the return fluid and the reversed fluid) to be discharged and another position (first position) 20*a*1 allowing the operation fluid to be supplied to the first hydraulic actuator 14.

In addition, the first control valve 20A can receive the return fluid and the reversed fluid again at the second position 20*a*2 and return the return fluid and the reversed fluid to the supply side of the first hydraulic actuator 14.

According to that configuration, when the operation of shortening the first hydraulic actuator 14 and the operation of moving the boom downward are performed for example, the return fluid or the reversed fluid can be supplied to the communication fluid tube 21*b* in addition to the operation fluid discharged by the first hydraulic pump P1.

As the result, the response to the operation of moving the boom downward (boom moving-down operation) becomes faster, and thus the boom can be moved smoothly and quickly. In other words, since at least the return fluid and the reversed fluid are added to the operation fluid discharged by the first hydraulic pump P1, it is possible to prevent the flow rate of the operation fluid required for the boom moving-down operation from temporarily exceeding the flow rate of the operation fluid discharged from the hydraulic pump P1 when the boom lowering operation is performed quickly, for example.

In the above-described embodiments, the operation fluid is discharged to the operation fluid tank. However, the operation fluid may be discharged to other places. That is, the fluid tube for discharging the hydraulic fluid may be connected to a portion other than the operation fluid tank. For example, the fluid tube may be connected to the suction portion of the hydraulic pump (the portion for sucking the operation fluid) or to another portion.

In the above-described embodiments, the control valve is constituted of a three-position switching valve. However, the number of switching positions is not limited, and the control valve may be constituted of a two-position switching valve, a four-position switching valve, or another switching valve. In the above-described embodiment, the hydraulic pump is constituted of a constant displacement pump. However, the hydraulic pump may be constituted of a variable displacement pump whose discharge amount is changed by movement of the swash plate, or may be constituted of another hydraulic pump, for example.

In addition, the first hydraulic actuator, the second hydraulic actuator, the third hydraulic actuator, the first control valve, the second control valve, and the third control valve are not limited to the configurations of the above-described embodiment, and may be those provided in the working machine 1.

Second Embodiment

Figure 3:
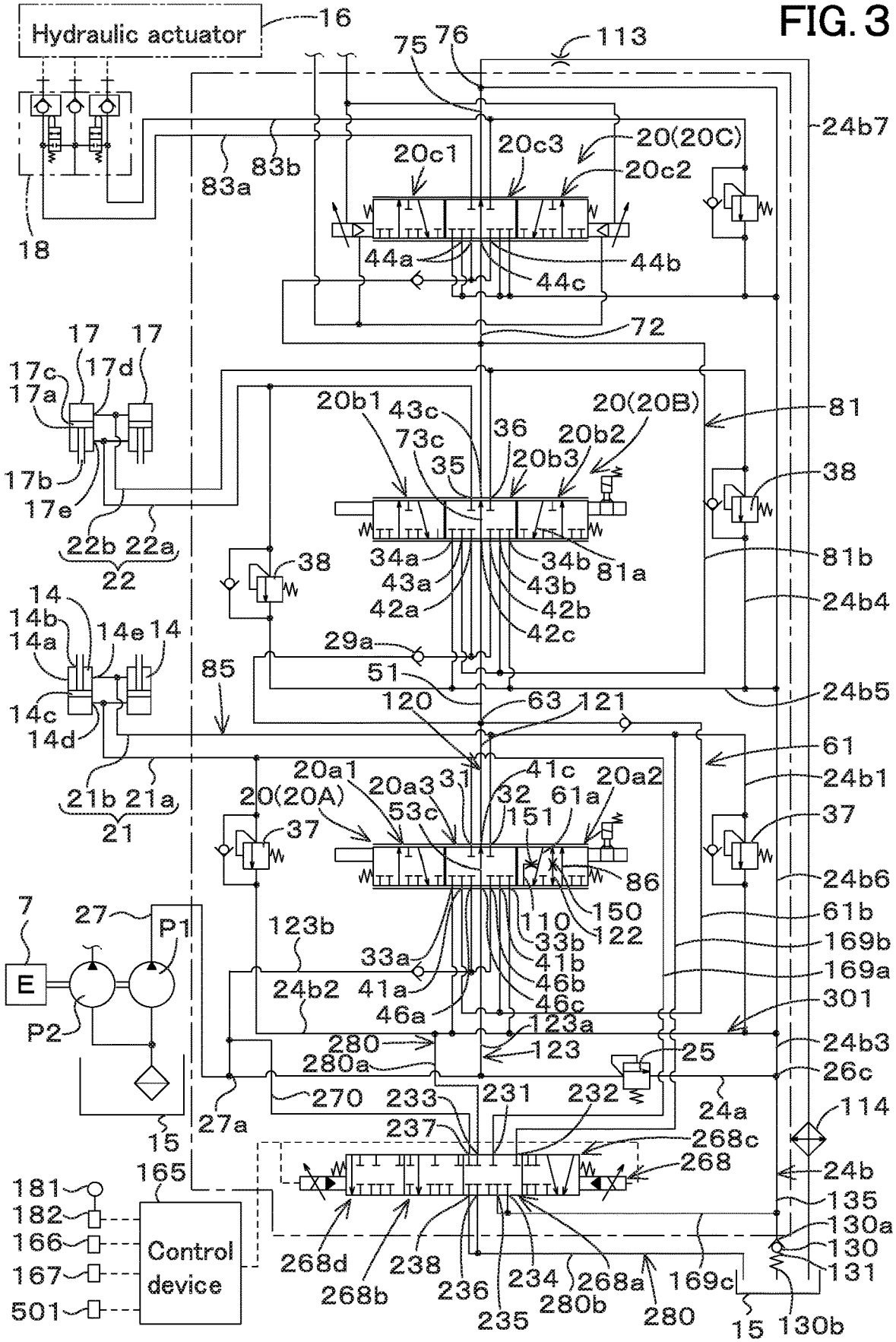
FIG. 3 is a view illustrating a hydraulic system (hydraulic circuit) for a working machine according to a second embodiment of the present invention.
Figure 4:
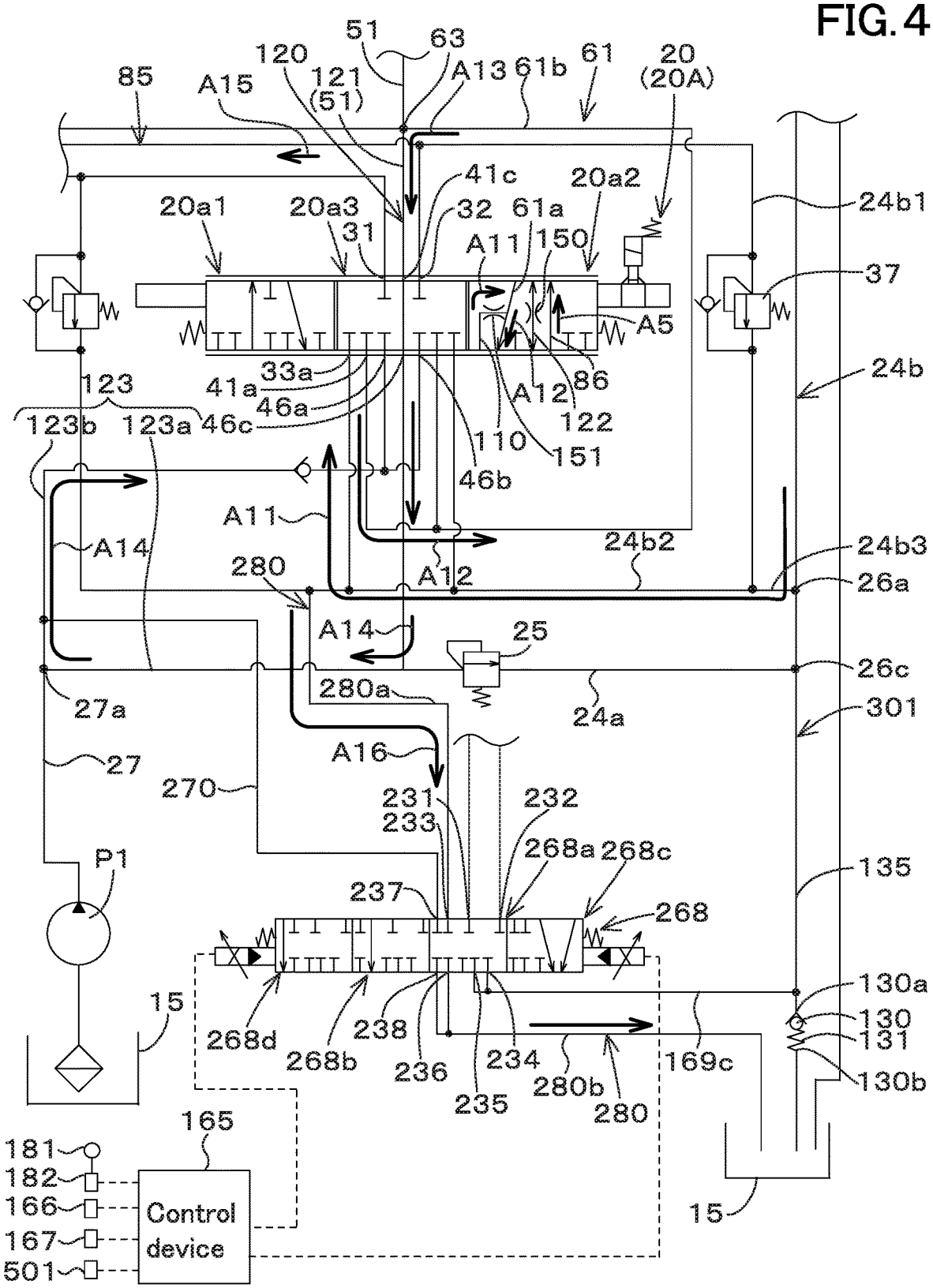
FIG. 4 is an explanation view explaining flowing of an operation fluid according to the second embodiment.
Figure 5:
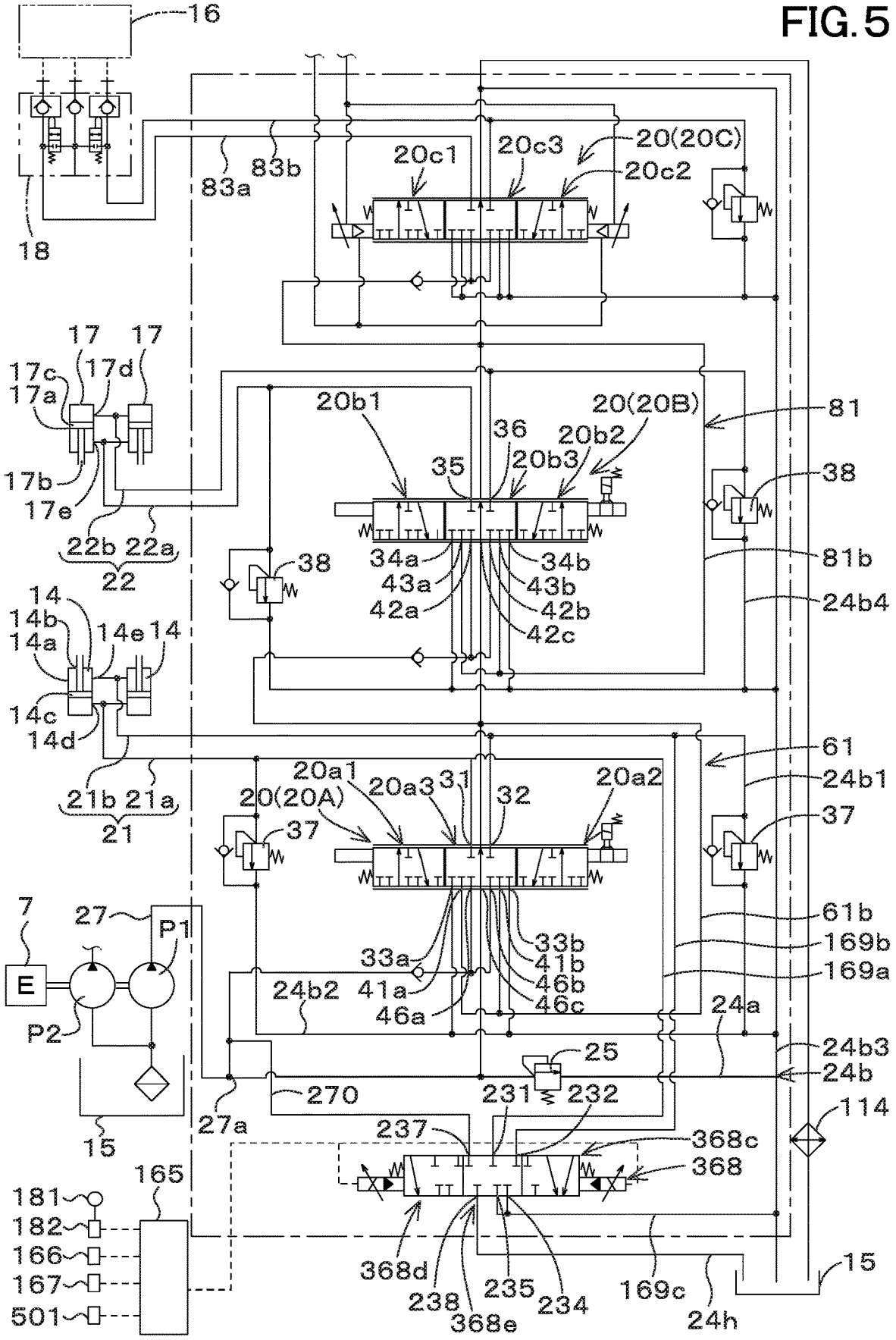
FIG. 5 is a view illustrating a first modified example of the hydraulic system for the working machine according to the second embodiment.

FIG. 3 to FIG. 5 show a hydraulic system for a working machine according to a second embodiment. In the second embodiment, descriptions of configurations similar to those of the first embodiment will be omitted. The discharge fluid tube 24 is configured to discharge, to the operation fluid tank 15 and the like, the operation fluid that has passed through the second control valve 20B.

The discharge fluid tube 24 includes a fluid tube 24*b*2 and a fluid tube 24*b*3. A relief valve 37 is provided in the middle of the fluid tube 24*b*2. Further, the fluid tube 24*b*3 couples the operation fluid tank 15 to the confluent portion 26*a* of the fluid tube 24*b*1 and the fluid tube 24*b*2.

Further, the discharge fluid tube 24*b* includes the fluid tube 24*b*4, the fluid tube 24*b*5, the fluid tube 24*b*6, and the fluid tube 24*b*7. The fluid tube 24*b*4 is a fluid tube connected to the communication fluid tube 22*b*. A relief valve 38 is provided in the middle of the fluid tube 24*b*1.

The fluid tube 24*b*5 is a fluid tube connected to the communication fluid tube 22*a* and to the first discharge port 34*a* and the second discharge port 34*b* of the second control valve 20B. A relief valve 38 is also provided in the middle of the fluid tube 24*b*5.

The fluid tube 24*b*6 connects the fluid tube 24*b*3 to the confluent portion 26*b* of the fluid tube 24*b*1 and the fluid tube 24*b*2. In addition, the fluid tube 24*b*6 is communicated with a central fluid tube 75 that is communicated with the central fluid tube 72.

The fluid tube 24*b*7 connects the operation fluid tank 15 and the like to the confluent portion 76 in which the fluid tube 24*b*6 and the central fluid tube 75 are connected to each other. The fluid tube 24*b*7 is provided with the throttle portion 113 for reducing the flow rate of the operation fluid and the oil cooler 114 for cooling the operation fluid.

The hydraulic system for the working machine has two routes or systems for discharging the operation fluid from the first control valve 20A. That is, the hydraulic system for the working machine includes the first system discharge fluid tube 301 and the second system discharge fluid tube, which may be referred to simply as the first and second discharge fluid tubes, respectively.

The first system discharge fluid tube 301 includes a fluid tube connected to the discharge port (the first discharge port 33*a* and the second discharge port 33*b*) of the first control valve 20A. More specifically, the first system discharge fluid tube 301 has a fluid tube 24*b*2 and a fluid tube 24*b*3.

A pressure increasing portion 130 is connected to the first system discharge fluid tube 301. The pressure increasing portion 130 is a portion configured to increase at least the pressure of the first system discharge fluid tube 301. The pressure increasing portion 130 is a check valve provided in the fluid tube 24*b*3.

In particular, the check valve is provided in a section 135 of the discharge fluid tube 24*b*3 between the operation fluid tank 15 and the confluent portion 26*c* in which the discharge fluid tube 24*b*3 and the discharge fluid tube 24*a* are connected to each other.

The check valve is a valve configured to allow the operation fluid to flow from the confluent portion 26*a* side (the confluent portion 26*c* side) toward the operation fluid tank 15 and prevent the operation fluid from flowing from the operation fluid tank 15 side toward the confluent portion 26*a* side (the confluent portion 26*c* side). The check valve has a setting member 131 configured to set the differential pressure.

The setting member 131 is constituted of a spring or the like, and generates a differential pressure when a valve body is pushed with a predetermined pushing force from a side (a direction for the prevention) opposite to the direction allowing the flow of the operation fluid. In the embodiment described above, the pressure increasing portion 130 is constituted of a check valve. However, the pressure increasing portion 130 may be constituted of anything as long as the pressure of the discharge fluid tube 24*b* can be increased. For example, the pressure increasing portion 130 may be constituted of an oil cooler, a relief valve, a throttle portion (a throttle valve), or a choke valve.

The second system discharge fluid tube is a fluid tube connected to the first system discharge fluid tube 301 and configured to discharge the operation fluid separately from the first system discharge fluid tube 301. The second system discharge fluid tube is the branched fluid tube 280 branched from the fluid tube 24*b*2. The branched fluid tube 280 is a fluid tube extending to a discharge portion for discharging the operation fluid.

The discharge portion is a suction portion (a portion for sucking the operation fluid) of the operation fluid tank or the hydraulic pump. It should be noted that the discharge portion may be any portion from which the operation fluid is discharged, and may be a portion other than the suction portion of the operation fluid tank or the hydraulic pump. Thus, the discharge portion is not limited thereto.

The second system discharge fluid tube (branched fluid tube 280) includes a fluid tube 280*a* and a fluid tube 280*b*. The fluid tube 280*a* is a fluid tube branched from the fluid tube 24*b*2 and connected to the float switching valve 268. The fluid tube 280*b* is a fluid tube that is connected to the float switching valve 268 and extends to the discharge portion such as the operation fluid tank 15.

The float switching valve 268 is at least a three position switching valve, and is configured to be switched between an allowance position 268*a*, a prevention position 268*b*, and a float position 268*c*. In the case where the float switching valve 268 is switched to the allowance position 268*a*, the float switching valve 268 blocks fluid communication through the second system discharge fluid tube (branched fluid tube 280), thereby supplying the operation fluid to the pressure increasing portion 130.

In the case where the float switching valve 268 is switched to the prevention position 268*b*, the float switching valve 268 unblocks the second system discharge fluid tube (branched fluid tube 280), preventing the flow of operation fluid from flowing toward the pressure increasing portion 130. In the case where the float switching valve 268 is in the float position 268*c*, the float switching valve 268 discharges the operation fluid in the first hydraulic actuator 14 through a fluid tube other than the first system discharge fluid tube 301 and the second system discharge fluid tube (branched fluid tube 280).

In the embodiment, the float switching valve 268 can be switched to the unload position 268*d* in addition to the allowance position 268*a*, the prevention position 268*b*, and the float position 268*c*. In the case where the float switching valve 268 is in the unload position 268*d*, the float switching valve 268 discharges, to the second system discharge fluid tube (branched fluid tube 280), the operation fluid outputted from the first hydraulic pump P1, thereby stopping the supply of the operation fluid at least to the first control valve 20A and the second control valve 20B.

The float switching valve 268 is configured to be switched to the prevention position 268*b* when the spool is moved to one direction and further to be switched to the unload position 268*b* when the spool is moved to another direction.

Hereinafter, the float switching valve 268 will be described in detail.

The float switching valve 268 has a first port 231, a second port 232, a third port 233, a fourth port 234, a fifth port 235, a sixth port 236, a seventh port 237, and an eighth port 238. A fluid tube 169*a* branched from the communication fluid tube 21*a* is connected to the first port 231, and a fluid tube 169*b* branched from the communication fluid tube 21*b* is connected to the second port 232.

In addition, the fourth port 234 and the fifth port 235 are connected to the fluid tube 169*c*. The fluid tube 169*c* is a fluid tube coupling the fourth port 234 and the fifth port 235 to the inflow port 130*a* of the pressure increasing portion 130. The fluid tube 169*a*, the fluid tube 169*b*, and the fluid tube 169*c* constitute another route for discharging the operation fluid (which may be referred to as a third system discharge fluid tube or simply as a third discharge fluid tube) other than the first system discharge fluid tube 301 and the second system discharge fluid tube, and serve as a discharge fluid tube for the floating.

A branched fluid tube 280 is connected to the third port 233, the sixth port 236, and the eighth port 238. In particular, the fluid tube 280*a* of the branched fluid tube 280 is connected to the third port 233, and the fluid tube 280*b* of the branched fluid tube 280 is connected to the sixth port 236 and the eighth port 238.

An unload fluid tube 270 branched from the middle of the output fluid tube 40 and connected to the float switching valve 268 is connected to the seventh port 237. The unload fluid tube 270 is connected to the section fluid tube 123*b* in the output fluid tube 40, for example.

When the float switching valve 268 is in the float position 268*c*, the spool of the float switching valve 268 communicates the first port 231 and the fifth port 235 with each other, and communicates the second port 232 and the fourth port 234 with each other. As the result, when the float switching valve 268 is in the float position 268*c*, the operation fluid in the communication fluid tube 21*a* passes through the fluid tube 169*a* and the fluid tube 169*c*, passes through the pressure increasing portion 130 after reaching the pressure increasing portion 130, and then is discharged to the operation fluid tank 15.

That is, when the float switching valve 268 is in the float position 268*c*, the operation fluid inside the first actuator 14 is discharged to the operation fluid tank 15, and thus the float operation is performed.

When the float switching valve 268 is in the prevention position 268*b*, the spool of the float switching valve 268 communicates the third port 233 and the sixth port 236 with each other. In addition, when the float switching valve 268 is in the prevention position 268*b*, the spool of the float switching valve 268 blocks the communication between the first port 231 and the fifth port 235, the communication between the second port 232 and the fourth port 234, and the communication between the seventh port 237 and the eighth port 238.

That is, when the float switching valve 268 is in the prevention position 268*b*, the branched fluid tube 280 is unblocked for fluid communication between the fluid tube 280*a* and the fluid tube 280*b* through the float switching valve 268. As the result, when the float switching valve 268 is in the prevention position 268*b*, the operation fluid discharged from either one of the first discharge port 33*a* and the second discharge port 33*b* of the first control valve 20A flows through the fluid tube 280*a* and the fluid tube 280*b* and then is discharged to the operation fluid tank 15.

When the float switching valve 268 is in the allowance position 268*a*, the spool of the float switching valve 268 blocks the communication between the first port 231, the second port 231, the third port 231, the fourth port 231, the fifth port 231, the sixth port 231, the seventh port 231, and the eighth port 238. That is, when the float switching valve 268 is in the allowance position 268*a*, the branched fluid tube 280 is blocked.

As described above, the branched fluid tube 280 is blocked under a state where the float switching valve 268 is in the allowance position 268*a*. Thus, the flow of the operation fluid in the section 135 of the discharge fluid tube 24*b*3 is changed at the upstream side from the inflow port 130*a* of the pressure increasing portion 130.

When a differential pressure is generated by the throttle portion 151 provided in the third fluid tube 110 connected to the first system discharge fluid tube 301 and then the pressure in the first inner fluid tube 61*a* is lowered, the operation fluid in the first system discharge fluid tube 301 passes through the first discharge port 33*a* and flows to the third fluid tube 110 as indicated by an arrowed line A11 in FIG. 4.

As indicated by an arrowed line A12 in FIG. 4, the operation fluid (reversed fluid) flowing backward to the third fluid tube 110, the return fluid flowing in the first inner fluid tube 61*a* communicated with the third fluid tube 110, and the like flows through the first inner fluid tube 61*a* and the first output port 41*a* and flows to the outer fluid tube 61*b*.

As indicated by an arrowed line A13 in FIG. 4, a part of the operation fluid in the outer fluid tube 61*b* flows through the confluent portion 63, flows in the coupling fluid tube 121 and the third inner fluid tube 122, and is discharged from the third input port 46*c*.

In addition, as indicated by an arrowed line A14 in FIG. 4, the operation fluid discharged from the third input port 46*c* flows through the return fluid tube 123, returns to the first control valve 20A again, and enters the second input port 46*b* of the first control valve 20A. As indicated by an arrowed line A15 in FIG. 4, the operation fluid that having entered the second input port 46*b* of the first control valve 20A flows through the second inner fluid tube 86 of the second fluid tube 85, and then flows into the communication fluid tube 21*b* of the second fluid tube 85.

That is, as indicated by the arrowed lines A11 to A15 in FIG. 4, when the float switching valve 268 is set to the allowance position 268*a*, the flow of the operation fluid in the first system discharge fluid tube 301 can be reversed, and the reversed operation fluid and the like can be supplied to the communication fluid tube 21*b* in which the supply fluid flows.

According to that configuration, when the operation of shortening the first hydraulic actuator 14 and the operation of moving the boom downward are performed, for example, the return fluid or the reversed fluid can be supplied to the communication fluid tube 21*b* in addition to the operation fluid outputted by the first hydraulic pump P1.

As the result, the response to the operation of moving the boom downward becomes faster, and thus the boom can be smoothly moved downward at a quick speed.

In other words, since at least the return fluid and the reversed fluid are added to the operation fluid outputted by the first hydraulic pump P1, it is possible to prevent the flow rate of the operation fluid required for the boom downward movement from temporality exceeding the flow rate of the operation fluid outputted from the first hydraulic pump P1 when the boom downward movement is performed quickly or the like.

On the other hand, since the second system discharge fluid tube (branched fluid tube 280) is unblocked under a state where the float switching valve 268 is at the prevention position 268*b*, the operation fluid in the discharge fluid tube 24*b*3 flows through the second system discharge fluid tube (branched fluid tube 280) and flows toward the operation fluid tank 15 and the like as indicated by an arrowed line A16 in FIG. 4.

Thus, since the pressure increasing portion 130 stops working, the pressure of the operation fluid in the section 135 of the discharge fluid tube 24*b*3 is not increased. In that case, the operation fluid having flown through the third fluid tube 110 of the first control valve 20A can be supplied toward the operation fluid tank 15 and the like.

For example, since the return fluid has no place to be supplied when the bucket 11 or the auxiliary actuator stops moving due to some circumstances and the return fluid form the first control valve 20A can no longer be supplied to the second control valve 20B through the first fluid tube 61, it is conceivable that the first hydraulic actuator 17 is difficult to move.

In the embodiment, since the third fluid tube 110 and the second system discharge fluid tube (branched fluid tube 280) are provided, the return fluid, which cannot be supplied from the first control valve 20A to the second control valve 20B, can be escaped to the operation fluid tank 15 through the third fluid tube 110 and the second system discharge fluid tube (branched fluid tube 280). In this manner, the first hydraulic actuator 17 can be moved smoothly.

That is, since the return fluid on the rod side of the first hydraulic actuator 17 can be returned to the bottom side of the first hydraulic actuator 17, the speed of stretching the first hydraulic actuator 17 can be improved. By switching over the float switching valve 268, it is possible to efficiently perform the regeneration for returning the operation fluid back to the first control valve 20A, and it is possible to improve the fuel consumption of the working machine.

When the float switching valve 268 is in the unload position 268*d*, the spool of the float switching valve 268 allows the seventh port 237 and the eighth port 238 to communicate with each other. In this manner, the operation fluid (supply fluid) outputted from the first hydraulic pump P1 can be supplied through the unload fluid tube 270 and discharged from the second system discharge fluid tube (branched fluid tube 280) to the discharge portion.

The control device 165 is connected to the float switching valve 268. An operation detection device 182 is connected to the control device 165, and the operation detection device 182 is configured to detect the operation of the operation member 181. The operation detecting device 182 is constituted of a sensor configured to detect the rotation of the operation member 181, a sensor configured to detect the operation of a spool or the like of the control valve 20 operated by the operation member 181, a sensor configured to detect a pilot pressure applied to a pressure receiving portion of the control valve 20 operated by the operation member 181.

The operation detection device 182 may be constituted of any device as long as it is a device configured to detect whether the operation member 181 is operated. In addition to the above-mentioned example, the operation detection device 182 may determine, based on detection of the operation or the like of the hydraulic actuator, whether or not the operation member 181 has been operated.

When at least neither the first hydraulic actuator 14 nor the second hydraulic actuator 17 is operated by the operation detection device 182 (the operation member 181 is not operated), the control device 165 outputs a control signal to switch the float switching valve 268 to the unload position 268*d*.

That is, when the operation member 181 is not operated, the float switching valve 268 is held at the unload position 268*d*.

Thus, since the float switching valve 268 is set to the unload position 268*d* under the condition that the operation member 181 is not operated, that is, when the operation member 181 is in the neutral position, the loss of horsepower of the pump can be suppressed.

On the other hand, when the operation member 181 is operated, that is, when either the first hydraulic actuator 14 or the second hydraulic actuator 17 is operated, the float switching valve 268 can be switched to either one of the allowance position 268*a*, the prevention position 268*b*, the float position 268*c*. The switching between the allowance position 268*a*, the prevention position 268*b*, and the float position 268*c* is performed by the operation member 166, the operation member 167, and the like each connected to the control device 165.

The operation member 166 and the operation member 167 are switches configured to be switched between ON and OFF. For example, when the operator turns on the operation member 166, the control device 165 outputs a control signal to the float switching valve 268 to switch the float switching valve 268 to the prevention position 268*b*.

When the operator turns off the operation member 166, the control device 165 outputs a control signal to the float switching valve 268 to switch the float switching valve 268 to the allowance position 268*a*.

In addition, when the operator turns on the operation member 167, the control device 165 outputs a control signal to the float switching valve 268 to switch the float switching valve 268 to the float position 268*c*. When the operator turns off the operation member 167, the control device 165 outputs a control signal to the float switching valve 268 to switch the float switching valve 268 to a position other than the float position 268*c*, for example, to the allowance position 268*a*.

An engine speed sensor 501 for detecting the engine revolution speed is connected to the control device 165. The control device 165 refers to the engine rotation speed detected by the engine speed sensor 501 at the time of starting the engine, and holds the float switching valve 268 at the unload position 268*d* until the engine rotation speed exceeds a predetermined revolution speed (a start determination revolution speed). Further, when the engine speed exceeds the start determination revolution speed, the control device 165 switches the float switching valve 268 to a position other than the unload position 268*d*, for example, to the allowance position 268*a*.

According to that configuration, since the float switching valve 268 is held at the unload position 268*d* at the time of starting the engine, the torque provided for the starting of the engine can be increased. In other words, it is possible to suppress the decreasing of torque of the engine itself which is caused due to the influence of the first hydraulic pump P1 or the like at the time of starting the engine.

In the above-described embodiment, the pressure (back pressure) of the operation fluid in the first system discharge fluid tube 301 is increased. However, the float control valve is also applicable to a hydraulic circuit (hydraulic system) that does not increase the back pressure.

FIG. 5 shows a diagram of a first modified example in which the float control valve is applied to a hydraulic circuit (hydraulic system) that does not increase the back pressure. In the first modified example shown in FIG. 5, the first system discharge fluid tube 301, the second system discharge fluid tube (branched fluid tube 280), the pressure increasing portion 130 connected to the first system discharge fluid tube 301, the third fluid tube 110, the throttle portion 151, the third inner fluid tube 122, and the like are not provided.

The float switching valve 368 has a first port 231, a second port 232, a fourth port 234, a fifth port 235, a seventh port 237, and an eighth port 238. The first port 231, the second port 232, the fourth port 234, and the fifth port 235 are similar to those of the float switching valve 268 in the above-described embodiment. An unload fluid tube 270 is connected to the seventh port 237, and a discharge fluid tube

24*h* that is different from the above-described second system discharge fluid tube (branched fluid tube 280) is connected to the eighth port 238.

The float switching valve 368 is at least a three position switching valve, and configured to be switched to a float position 368*c*, an unload position 368*d*, and a neutral position 368*e*. In the case where the float switching valve 368 is in the float position 368*c*, the float switching valve 368 discharges the operation fluid of the first hydraulic actuator 14 to the third system discharge fluid tube constituted of the fluid tube 169*a*, the fluid tube 169*b*, and the fluid tube 169*c*.

In the case where the float switching valve 368 is in the unload position 368*d*, the float switching valve 368 discharges, to the discharge fluid tube 24*h*, the operation fluid outputted from the first hydraulic pump P1, and thereby at least the supply of the operation fluid to the first control valve 20A and the second control valve 20B is suppressed.

In addition, also in the first modified example, when at least neither the first hydraulic actuator 14 nor the second hydraulic actuator 17 is operated by the operation detection device 182 (the operation member 181 is not operated), the control device 165 outputs a control signal to switch the float switching valve 368 to the unload position 368*d*.

That is, when the operation member 181 is not operated, the float switching valve 368 is held at the unload position 368*d*. Thus, also in the first modified example, since the float switching valve 368 is set to the unload position 368*d* under the condition that the operation member 181 is not operated, that is, when the operation member 181 is in the neutral position, the loss of the horse power of the pump can be suppressed.

On the other hand, when the operation member 181 is operated, that is, when either the first hydraulic actuator 14 or the second hydraulic actuator 17 is operated, the float switching valve 368 can be switched to the float position 368*c*.

In addition, when the operator turns on the operation member 167, the control device 165 outputs a control signal to the float switching valve 368 to switch the float switching valve 368 to the float position 368*c*. When the operator turns off the operation member 167, the control device 165 outputs a control signal to the float switching valve 368 to switch the float switching valve 368 to the neutral position 368*e*.

Also in the first modified example, the control device 165 refers to the engine rotation speed detected by the engine speed sensor 501 at the time of starting the engine, and holds the float switching valve 368 at the unload position 368*d* until the engine rotation speed exceeds a predetermined revolution speed (a start determination revolution speed). Further, when the engine speed exceeds the start determination revolution speed, the control device 165 switches the float switching valve 368 to a position other than the unload position 368*d*, for example, to the neutral position 368*e*.

According to that configuration, since the float switching valve 268 is held at the unload position 268*d* at the time of starting the engine, the torque provided for the starting of the engine can be increased. In other words, it is possible to suppress the decreasing of torque of the engine itself which is caused due to the influence of the first hydraulic pump P1 or the like at the time of starting the engine.

In the above-described embodiments, the operation fluid is discharged to the operation fluid tank. However, the operation fluid may be discharged to other places. That is, the fluid tube for discharging the hydraulic fluid may be connected to a portion other than the operation fluid tank. For example, the fluid tube may be connected to the suction portion of the hydraulic pump (the portion for sucking the operation fluid) or to another portion.

In the above-described embodiments, the control valve is constituted of a three-position switching valve. However, the number of switching positions is not limited, and the control valve may be constituted of a two-position switching valve, a four-position switching valve, or another switching valve. In the above-described embodiment, the hydraulic pump is constituted of a constant displacement pump. However, the hydraulic pump may be constituted of a variable displacement pump whose discharge amount is changed by movement of the swash plate, or may be constituted of another hydraulic pump, for example.

In addition, the first hydraulic actuator, the second hydraulic actuator, the third hydraulic actuator, the first control valve, the second control valve, and the third control valve are not limited to the configurations of the above-described embodiment, and may be those provided in the working machine 1.

The first control valve and the second control valve are not limited to those of the above-described embodiments, and any control valve provided in the working machine may be adopted.

Third Embodiment

FIG. 6 to FIG. 9 show a hydraulic system for a working machine according to a third embodiment of the present invention. In the third embodiment, descriptions of components similar to those of the first embodiment or the second embodiment will be omitted.

The hydraulic system for the working machine includes the pressure increasing portion 130, the bypass fluid tube 140, and the switching valve 160. The pressure increasing portion 130 is a portion connected to the discharge fluid tube 24*b* and is configured to increase the pressure of the discharge fluid tube 24*b*. The pressure increasing portion 130 is a check valve provided in the discharge fluid tube 24*b*.

In particular, the check valve is provided in a section 135 of the discharge fluid tube 24*b*3 between the operation fluid tank 15 and the confluent portion 26*c* at which the discharge fluid tube 24*b*3 is connected to the discharge fluid tube 24*a*.

The check valve allows the operation fluid to flow from the confluent portion 26*a* side (the confluent portion 26*c* side) toward the operation fluid tank 15 and prevents the operation fluid from flowing from the operation fluid tank 15 side toward the confluent portion 26*a* side (the confluent portion 26*c*). The check valve has a setting member 131 for setting the differential pressure.

The setting member 131 is constituted of a spring or the like, and generates the differential pressure by pushing the valve body with a predetermined pushing force from a direction (preventing direction) opposed to the direction allowing the flow of the operation fluid. In the embodiment described above, the pressure increasing portion 130 is constituted of a check valve, but anything may be used as long as the pressure of the discharge fluid tube 24*b* is increased, and the oil cooler, the relief valve, the throttle portion (throttle valve), or a choke valve may be employed.

The bypass fluid tube 140 is a fluid tube that constitutes a part of the discharge fluid tube 24*b*, and is a fluid tube that bypasses between the upstream side of the pressure increasing portion 130 and the downstream side of the pressure increasing portion 130. Specifically, in the section 135 of the discharge fluid tube 24*b*3, the upstream side upper than the inflow port 130*a* of the pressure increasing section 130 is connected to the downstream side lower than the discharge port 130*b* of the pressure rising section 130.

The switching valve 160 is constituted of at least a two-position switching valve, and is configured to be switched between an allowance position 160*a* and a prevention position 160*b*. The allowance position 160*a* allows the operation fluid to flow toward the pressure increasing portion 130. The prevention position 160*b* prevents the operation fluid from flowing toward the pressure increasing portion 130.

In particular, the switching valve 160 is provided in the bypass fluid tube 140, opens the bypass fluid tube 140 when the switching valve 160 is set to the prevention position 160*b*, and closes the bypass fluid tube 140 when the switching valve 160 is set to the allowance position 160*a*.

Figure 6:
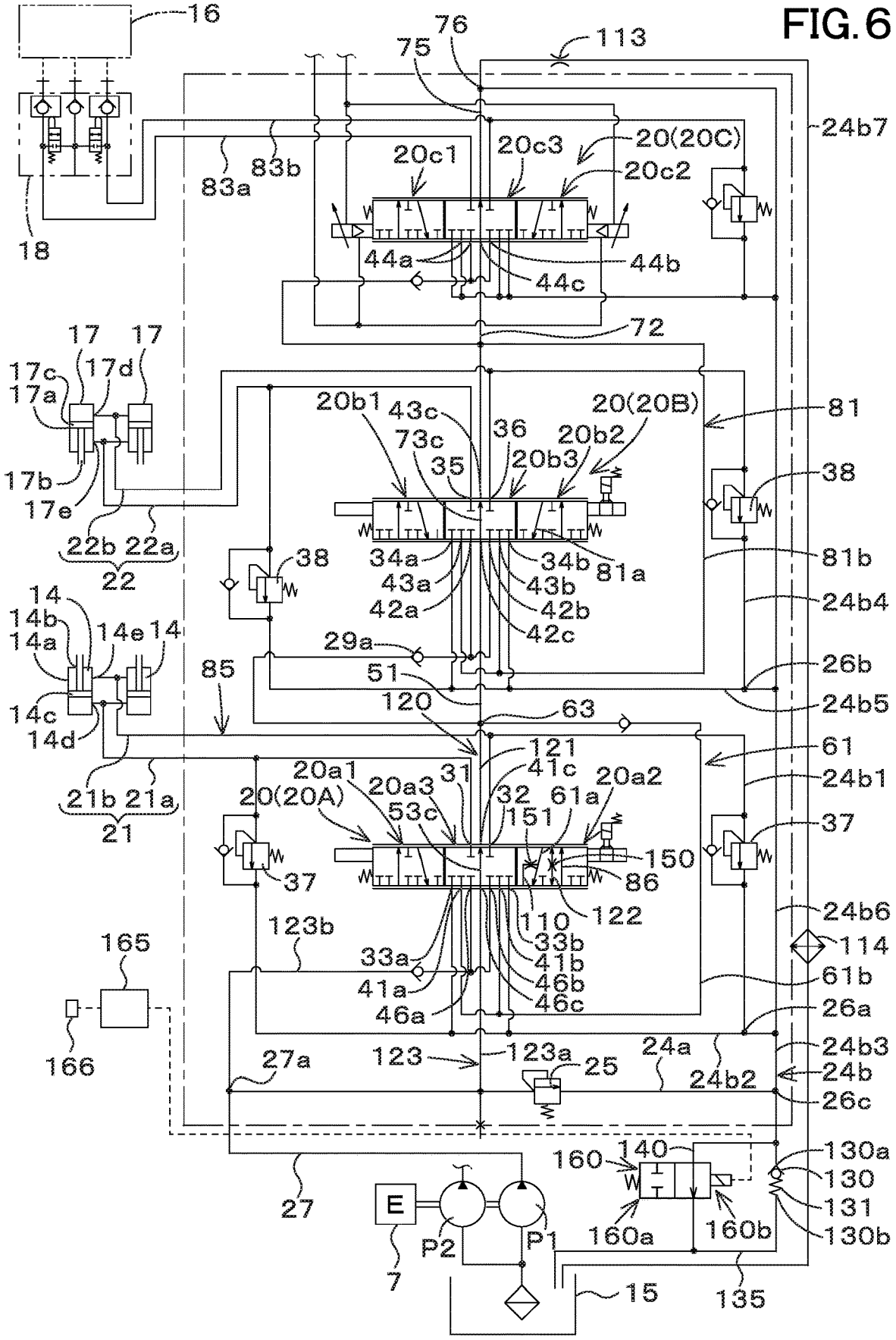
FIG. 6 is a view illustrating a hydraulic system (hydraulic circuit) for a working machine according to a third embodiment of the present invention.

In this embodiment, the switching valve 160 is switched by an electric signal. As shown in FIG. 6, a control device 165 constituted of a CPU or the like is connected to the switching valve 160. An operation member 166 is connected to the control device 165. The operation member 166 is a switch that is configured to be switched between ON and OFF.

For example, when the operator turns the operation member 166 on, the control device 165 outputs a control signal to the switching valve 160, and thereby the switching valve 160 is switched to the prevention position 160*b*.

When the operator turns the operation member 166 off, the control device 165 outputs a control signal to the switching valve 160, and thereby the switching valve 160 is switched to the allowance position 160*a*.

In the embodiment described above, the operator manually switches the switching valve 160 by manipulating the operating member 166. However, the control device 165 may automatically switch the switching valve 160 after judging the states or the like of the working machine.

According to the above configuration, since the bypass fluid tube 140 is closed when the switching valve 160 is set to the allowance position 160*a*, in the section 135 of the discharge fluid tube 24*b*3, the flow of operation fluid is changed on the upstream side upper than the inflow port 130*a* of the pressure increasing portion 130.

Figure 7A:
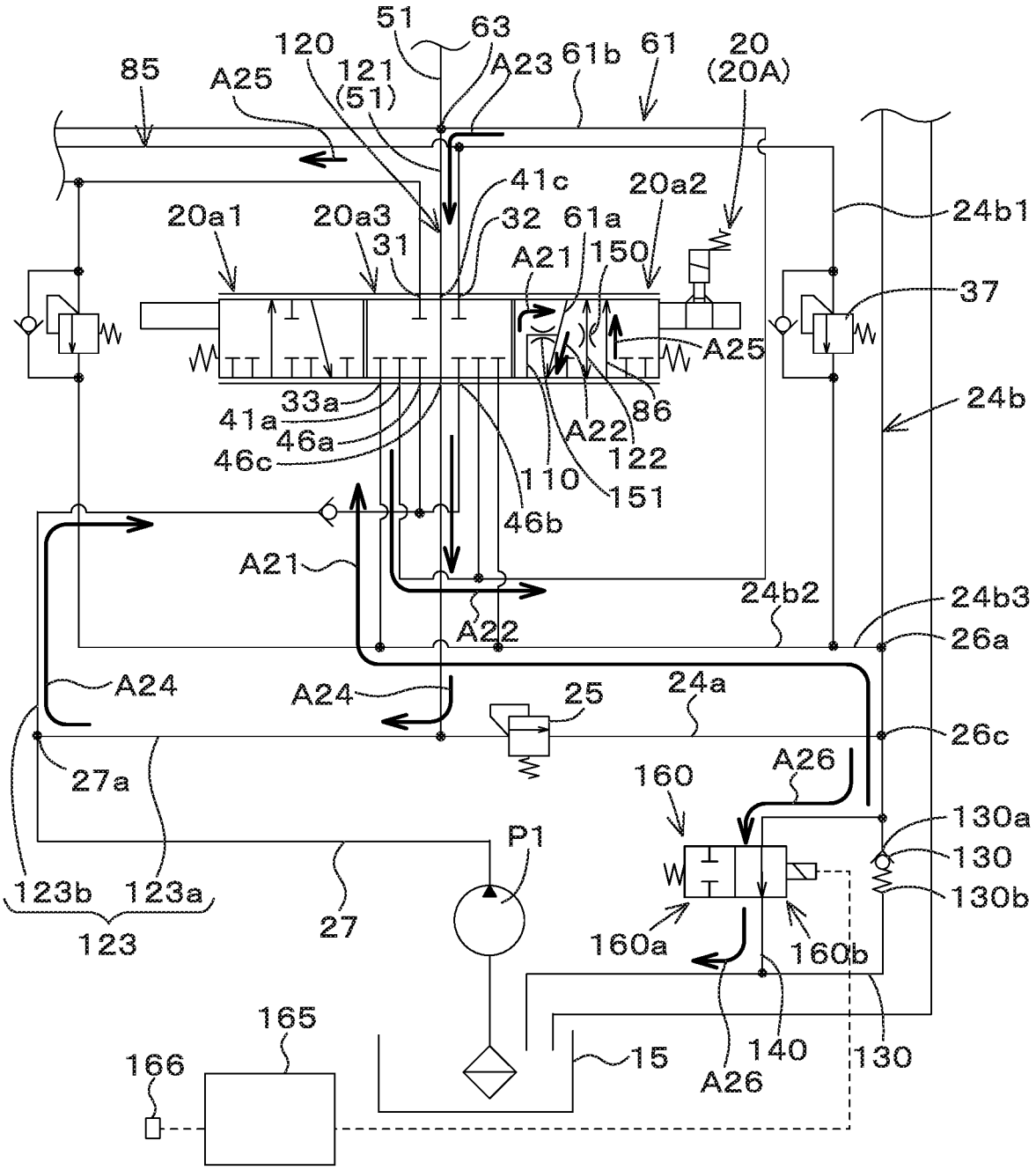
FIG. 7A is an explanation view explaining flowing of an operation fluid according to the third embodiment.

When the differential pressure is generated by the throttle portion 151 provided in the third fluid tube 110 that is connected to the discharge fluid tube 24*b*, and when the pressure of the first inner fluid tube 61*a* is lowered, the operation fluid of the discharge fluid tube 24*b* passes through the first discharge port 33*a* and flows to the third fluid tube 110 as shown by an arrowed line A21 in FIG. 7A.

As indicated by an arrowed line A22 in FIG. 7A, the operation fluid (reverse fluid) backwardly flown to the third fluid tube 110, the return fluid flowing in the first inner fluid tube 61*a* communicated with the third fluid tube 110, and the like pass through the first inner fluid tube 61*a* and the first output port 41*a*, and flow to the outer fluid tube 61*b*. As indicated by an arrowed line A23 in FIG. 7A, a part of the operation fluid in the outer fluid tube 61*b* flows in the coupling fluid tube 121 and the third inner fluid tube 122 through the confluent portion 63, and is discharged from the third input port 46*c*.

In addition, as indicated by an arrowed line A24 in FIG. 7A, the operation fluid discharged from the third input port 46*c* passes through the return fluid tube 123, returns to the first control valve 20A again, and enters the second input port 46*b* of the first control valve 20A. As indicated by an arrowed line A25 in FIG. 7A, the operation fluid that has entered the second input port 46*b* of the first control valve 20A flows through the second inner fluid tube 86 of the second fluid tube 85, and flows into the communication fluid tube 21*b* of the second fluid tube 85.

That is, as indicated by the arrowed lines A21 to A25 in FIG. 7A, when the switching valve 160 is set to the allowance position 160*a*, the operation fluid in the discharge fluid tube 24*b* can be forced to flow backward, and the operation fluid flowing reversely or the like cab be forced to be supplied to the communication fluid tube 21*b* in which the supply fluid flows.

According to that configuration, when the operation of shortening the first hydraulic actuator 14 and the operation of moving the boom downward are performed for example, the return fluid or the reversed fluid can be supplied to the communication fluid tube 21*b* in addition to the operation fluid discharged by the first hydraulic pump P1. As the result, the response to the operation of moving the boom downward (boom moving-down operation) becomes faster, and thus the boom can be moved smoothly and quickly.

In other words, since at least the return fluid and the reversed fluid are added to the operation fluid discharged by the first hydraulic pump P1, it is possible to prevent the flow rate of the operation fluid required for the boom moving-down operation from temporarily exceeding the flow rate of the operation fluid discharged from the hydraulic pump P1 when the boom lowering operation is performed quickly, for example.

On the other hand, when the switching valve 160 is set to the prevention position 160*b*, the bypass fluid tube 140 is opened, and thus the operation fluid in the discharge fluid tube 24*b*3 flows toward the operation fluid tank 15 and the like through the bypass fluid tube 140 as indicated by an arrowed line A26 in FIG. 7A.

In this manner, since the pressure increasing portion 130 stops working, the pressure of the operation fluid is not increased in the section 135 of the discharge fluid tube 24*b*3. In this case, the operation fluid that has passed through the third fluid tube 110 of the first control valve 20A can be supplied toward the operation fluid tank 15 and the like.

For example, when the bucket 11 or the auxiliary actuator stops moving due to some circumstances and thus the return fluid of the first control valve 20A cannot be supplied to the second control valve 20B through the first fluid tube 61, the return fluid in the first fluid tube 61 has no way to flow, it is conceivable that the first hydraulic actuator 17 becomes hard to move.

In this embodiment, since the third fluid tube 110, the discharge fluid tube 24*b*, and the bypass fluid tube 140 are provided, the return fluid which cannot be supplied from the first control valve 20A to the second control valve 20B is released to the operation fluid tank 15 through the third fluid tube 110, the discharge fluid tube 24*b*, and the bypass fluid tube 140. As the result, the first hydraulic actuator 17 can be moved smoothly.

That is, since the return fluid on the rod side of the first hydraulic actuator 17 can be returned to the bottom side of the first hydraulic actuator 17, the speed at the time of stretching of the first hydraulic actuator 17 can be improved.

In addition, by switching over the switching valve 160, it is possible to efficiently perform the regeneration for which the operation fluid is forced to reversely flow to the first control valve 20A, and it is possible to improve the fuel efficiency of the working machine.

Figure 7B:
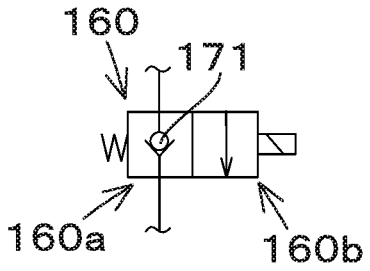
FIG. 7B is a view illustrating a modified example of a switching valve according to the third embodiment.

As shown in FIG. 7B, a check valve 171 may be provided in the switching valve 160. The check valve 171 is a valve configured to allow the operation fluid to flow from the operation fluid tank 15 and the like to the confluent portion 26*c* side and to prevent the operation fluid from flowing from the confluent portion 26*c* side to the operation fluid tank 15 side when the switching valve 160 is switched to the prevention position 160*b*.

Figure 8:
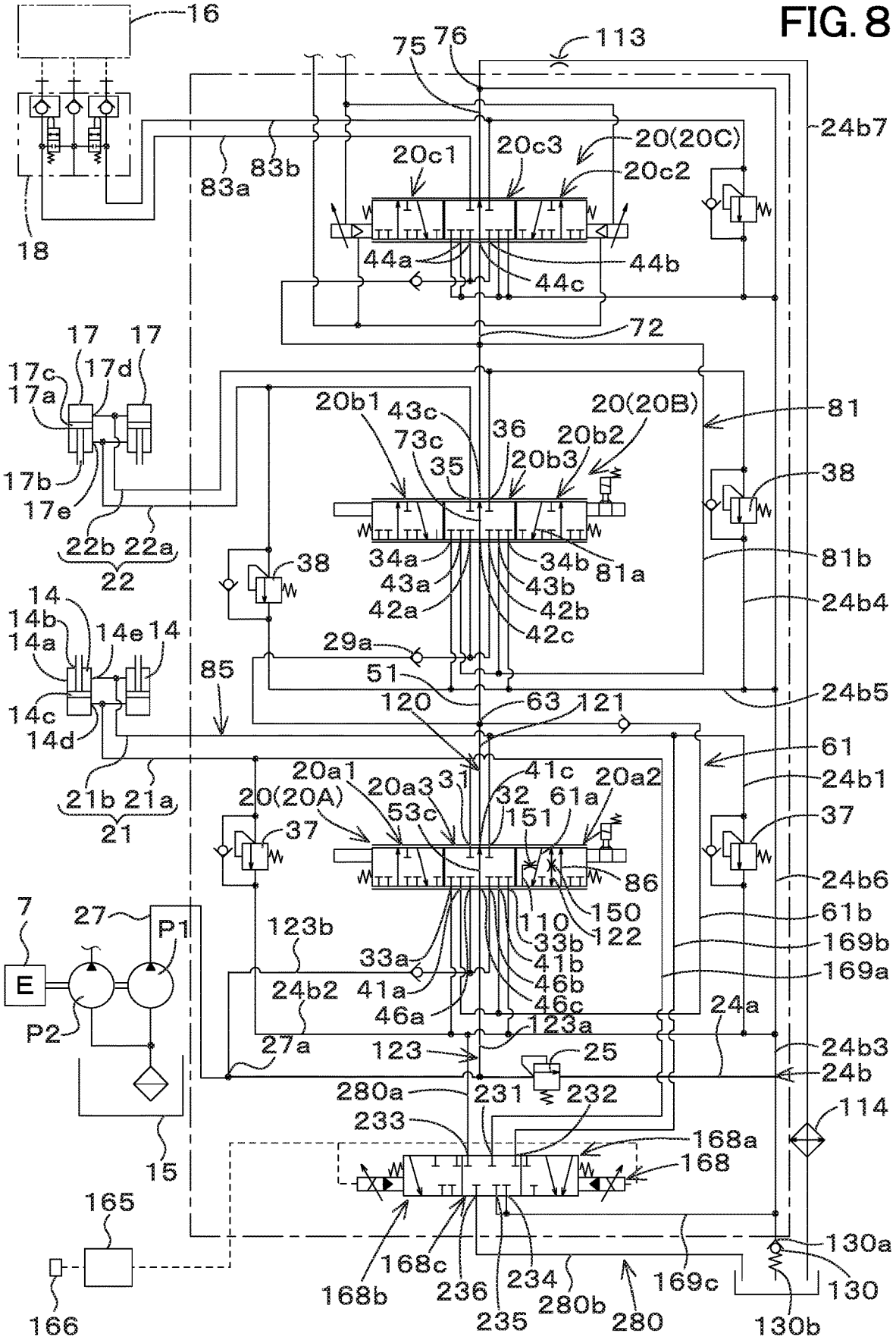
FIG. 8 is a view illustrating a second modified example of the hydraulic system for the working machine according to the third embodiment.

FIG. 8 shows a second modified example of the hydraulic system for the working machine. The hydraulic system for the working machine of the second modified example is provided with a switching valve 168 having a configuration different from the configuration of the switching valve 160 described above.

The switching valve 168 is a valve configured to be switched between an allowance position and a prevention position. The allowance position allows the operation fluid to flow toward the pressure increasing portion 130. The prevention position prevents the operation fluid from flowing toward the pressure increasing portion 130. In addition, the switching valve 168 is also a valve configured to perform the floating operation.

The switching valve 168 is constituted of a three-position switching valve and configured to be switched between a first position 168*a*, a second position 168*b*, and a third position 168*c*. In addition, the switching valve 168 has a first port 231, a second port 232, a third port 233, a fourth port 234, a fifth port 235, and a sixth port 236.

A fluid tube 169*a* branched from the communication fluid tube 21*a* is connected to the first port 231, and a fluid tube 169*b* branched from the communication fluid tube 21*b* is connected to the second port 232. In addition, the fourth port 234 and the fifth port 235 are connected to the fluid tube 169*c*. The fluid tube 169*c* is a fluid tube coupling the inflow port 130*a* of the pressure increasing portion 130 to the fourth port 234 and the fifth port 235.

The third port 233 and the sixth port 236 are connected to the branched fluid tube 280. The branched fluid tube 280 is a fluid tube extending to a discharge portion for discharging the operation fluid. The discharge portion includes the operation fluid tank, the suction portion of the hydraulic pump (a portion for sucking the operation fluid). It should be noted that the discharge portion may be a portion from which the operation fluid is discharged, and may be a portion other than the operation fluid tank and the suction portion of the hydraulic pump, and further is not limited thereto.

The fluid tube branched from the discharge fluid tube 24*b* and includes a fluid tube 280*a* and a fluid tube 280*b*. The fluid tube 280*a* is a fluid tube branched from the fluid tube 24*b*2 and connected to the third port 233. The fluid tube 280*b* is a fluid tube having one end connected to the sixth port 236 and the other end extending to the operation fluid tank 15.

When the switching valve 168 is set to the first position 168*a*, the spool of the switching valve 168 communicates the first port 231 and the fifth port 235 with each other and communicates the second port 232 and the fourth port 234 with each other. As the result, when the switching valve 168 is set to the first position 168*a*, the operation fluid in the communicating fluid tube 21*a* passes through the fluid tube 169*a* and the fluid tube 169*c*, reaches the pressure increasing portion 130, and then is discharged to the operation fluid tank 15 through the pressure increasing portion 130.

That is, when the switching valve 168 is set to the first position 168*a*, the operation fluid in the first actuator 14 is discharged to the operation fluid tank 15 through the first flow tube 281, and thus the floating operation is performed.

When the switching valve 168 is set to the second position 168*b*, the spool of the switching valve 168 communicates the third port 233 and the sixth port 236 with each other. In addition, when the switching valve 168 is set to the second position 168*b*, the spool of the switching valve 168 blocks the communication between the first port 231 and the fifth port 235, and blocks the communication between the second port 232 and the fourth port 234.

That is, when the switching valve 168 is set to the second position 168*b*, the branched fluid tube 280 is opened. As the result, when the switching valve 168 is set to the second position 168*b*, the operation fluid discharged from either of one of the first discharge port 33*a* or the second discharge port 33*b* of the first control valve 20A is discharged to the operation fluid tank 15 through the fluid tube 280*a* and the fluid tube 280*b*.

As described above, when the switching valve 168 is set to the second position (prevention position) 168*b*, the switching valve 168 prevents the operation fluid discharged from either one of the first discharge port 33*a* and the second discharge port 33*b* of the first control valve 20A from flowing toward the pressure increasing portion 130.

When the switching valve 168 is set to the third position (allowance position) 168*c*, the spool of the switching valve 168 blocks the communication between the third port 233 and the sixth port 236. That is, when the switching valve 168 is set to the second position 168*b*, the branched fluid tube 280 is closed.

Thus, the operation fluid discharged from either one of the first discharge port 33*a* and the second discharge port 33*b* of the first control valve 20A passes through the fluid tube 24*b*2 and the fluid tube 24*b*3 and reaches the pressure increasing portion 130, and thereby the pressure of the discharge fluid tube 24*b* can be increased.

Meanwhile, also in the second modified example, it is preferred that the switching of the switching valve 168 is controlled by the control device 165. In addition, the switching valve 168 may be manually or automatically switched, as in the above-described embodiments.

Thus, in the second modified example, when the switching valve 168 configured to perform the float operation is switched, it is possible to increase the pressure of the operation fluid in the discharge fluid tube 24*b* and to prevent the pressure of the operation fluid from increasing in the discharge fluid tube 24*b*.

Figure 9:
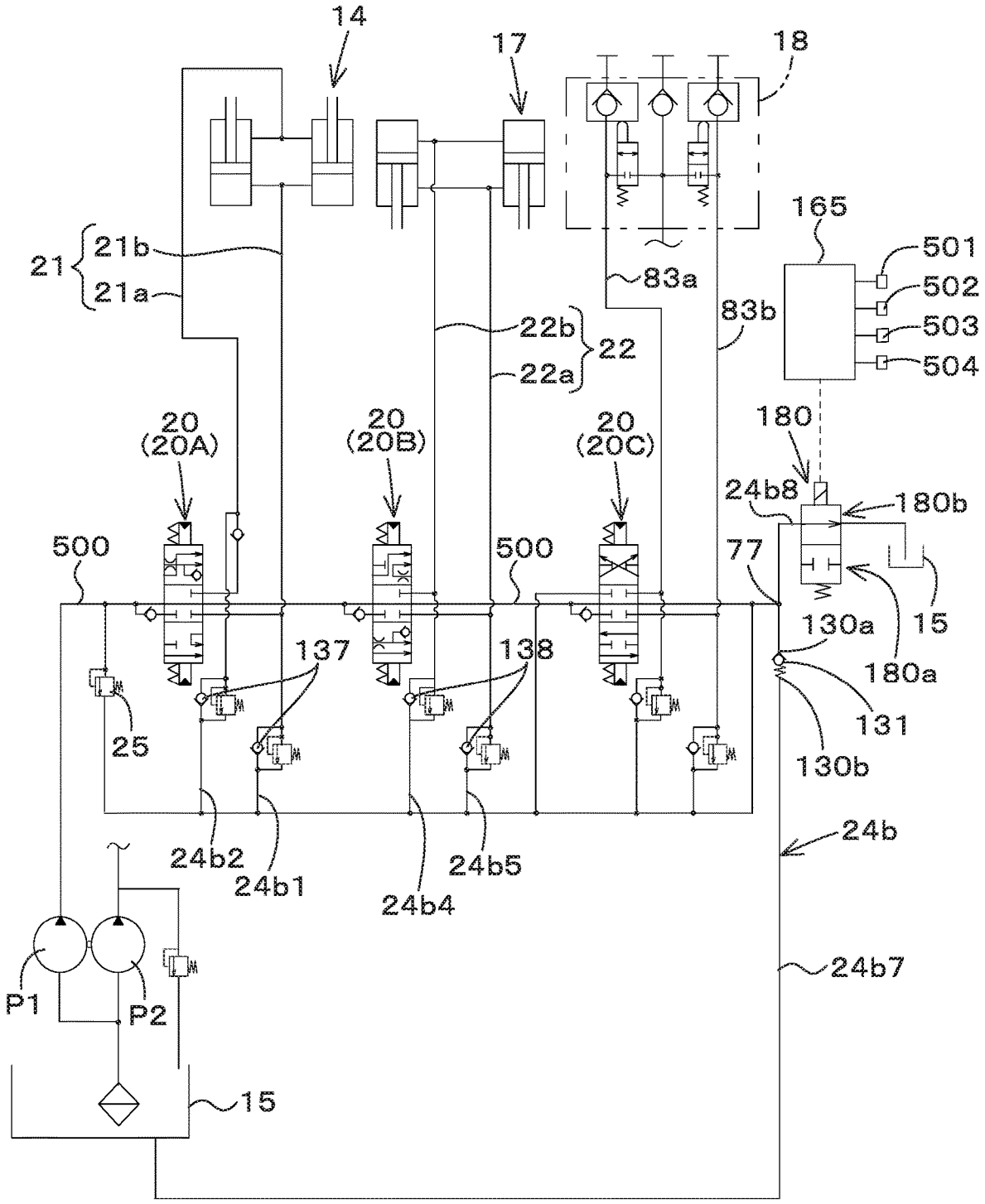
FIG. 9 is a view illustrating a third modified example of the hydraulic system for the working machine according to the third embodiment.

FIG. 9 shows a third modified example of the hydraulic system for the working machine. The hydraulic system for the working machine according to the third modified example is provided with a switching valve 180 having a configuration different from the configurations of the switching valve 160 and the switching valve 168 described above. The hydraulic system for the working machine according to the third modified example is a hydraulic circuit different from the series circuit described in the above embodiments.

As shown in FIG. 9, the hydraulic system for the working machine includes the boom control valve 20A, the bucket control valve 20B, and the auxiliary control valve 20C. The boom control valve 20A, the bucket control valve 20B, and the auxiliary control valve 20C are coupled each other by a central fluid tube 500. The boom control valve 20A and the boom cylinder 14 are coupled each other by the communication fluid tube 21*a* and the communication fluid tube 21*b*.

The bucket control valve 20B and the bucket cylinder 17 are coupled each other by the communication fluid tube 22*a* and the communication fluid tube 22*b*. The auxiliary control valve 20C and the hydraulic actuator 16 of the auxiliary attachment are coupled each other by a supplying-discharging fluid tube 83*a* and a supplying-discharging fluid tube 83*b*. The fluid tube 24*b*1 and the fluid tube 24*b*2 are provided with check valves 137. In addition, the fluid tube 24*b*4 and the fluid tube 24*b*5 are provided with check valves 138.

The check valve 137 is configured to suppress the negative pressure when the boom cylinder 14 is operated, the negative pressure being generated in the boom cylinder 14. The check valve 138 is configured to suppress the negative pressure when the bucket cylinder 17 is operated, the negative pressure being generated in the bucket cylinder 17. The circuit may be provided with a check valve 139 configured to suppress the negative pressure of the hydraulic actuator 16 of the auxiliary attachment.

That is, the hydraulic system for the working machine is provided with a check valve (check valves 137, 138, and 139) configured to suppress the negative pressure of the hydraulic actuator when the hydraulic actuator is operated. In other words, the check valve (check valves 137, 138, and 139) are check valves for the make-up operation.

Then, the fluid tube 24*b*7 of the discharge fluid tube 24*b* is provided with a pressure increasing portion 130. When the pressure increasing portion 130 is provided to increase the pressure of the discharge fluid tube 24*b*, the check valve (check valves 137, 138, and 139) are operated stably.

The hydraulic system for the working machine according to the third modified example is provided with a fluid tube 24*b*8 branched from the fluid tube 24*b*7 of the discharge fluid tube 24*b*. The fluid tube 24*b*8 is extended, to the operation fluid tank 15 and the like, from the branched portion 77 branched from the fluid tube 24*b*. The switching valve 180 is constituted of at least an two-position switching valve, and has an allowance position 180*a* and a prevention position 180*b*. The allowance position 180*a* allows the operation fluid to flow toward the pressure increasing portion 130. The prevention position 180*b* prevents the operation fluid from flowing toward the pressure increasing portion 130.

In particular, the switching valve 180 is provided in the fluid tube 24*b*8, is configured to open the fluid tube 24*b*8 when the switching valve 180 is set to the prevention position 180*b* and to close the fluid tube 24*b*8 when the switching valve 180 is set to the allowance position 180*a*. The switching valve 180 is configured to be switched by the control device 165. An engine speed sensor 501 for detecting the revolution speed of the prime mover, for example, the engine revolution speed when the prime mover is constituted of an engine is connected to the control device 165.

In addition, a detection device is connected to the control device 165, the detection device being configured to detect the state of the hydraulic actuator such as the boom cylinder 14, the bucket cylinder 17, and the hydraulic actuator 16 of the auxiliary attachment. The detection device is a stroke detection sensor 502, a pilot pressure detection sensor 503, and an operation amount detection sensor 504. The stroke detection sensor 502 is a sensor configured to detect the strokes of spools of the plurality of control valves 20, and can detect based on the detected stroke value whether the hydraulic actuator is in the stretched state or the shortened state.

The pilot pressure detection sensor 503 is a sensor configured to detect the pilot pressure applied to the pressure receiving portions of the plurality of control valves 20, and thus can detect, based on the detected pilot pressure, whether the hydraulic actuator is stretched or shortened.

The operation amount detection sensor 504 is a sensor configured to detect an operation amount of the operation lever or the like for operating the hydraulic actuator, and can detect, based on the detected operation amount, whether the hydraulic actuator is stretched or shortened.

For example, when the engine revolution speed detected by the engine speed sensor 501 is equal to or higher than the threshold value and the boom 10 is moved upward (the first condition), the control device 165 outputs a control signal for setting the switching valve 180 to the prevention position 180*b* (back-pressure signal) to the switching valve 180, and thereby the control device 165 reduces the pressure of the discharge fluid tube 24*b* (fluid tube 24*b*7).

In addition, also in the case where the engine revolution speed detected by the engine speed sensor 501 is equal to or higher than a threshold value and the bucket 11 performs the shoveling operation (second condition), the control device 165 also outputs a back-pressure lowering signal to the switching valve 180, and thereby the control device 165 reduces the pressure of the discharge fluid tube 24*b*.

In addition, when the temperature of the operation fluid is equal to or lower than a threshold value (the fourth condition) at the time of starting the engine (the third condition), the control device 165 outputs the back-pressure lowering signal to the switching valve 180 in the case where the strokes of the spools of all the control valves 20 are zero (the fifth condition).

That is, as shown in the first condition to the fifth condition, when the make-up operation is unnecessary, the control device 165 sets the switching valve 180 to the prevention position 180*b*, and thereby the control device 165 reduces the pressure of the discharge fluid tube 24*b*.

On the other hand, in a condition is other than the first condition to the fifth condition, that is, in a condition where the make-up operation is required, the control device 165 outputs a control signal for setting the switching valve 180 to the allowance position 180*a* to the switching valve 180, and thereby the control device 165 increases the pressure of the discharge fluid tube 24*b* (fluid tube 24*b*7).

In other words, in the case where the boom cylinder 14 is moved fast not by the operation fluid discharged from the first hydraulic pump P1 but by the weight of load when the heavy load is loaded on the bucket 11, the check valve (check valves 137, 138, and 139), that is, the hydraulic actuator corresponding to the check valve can be operated smoothly by setting the switching valve 180 to the allowance position 180*a* to increase the pressure of the discharge fluid tube 24*b*.

In addition, when the switching valve 180 is switched, it is possible to eliminate unnecessary make-up operation and to improve the fuel efficiency of the working machine.

In the above-described embodiments, the operation fluid is discharged to the operation fluid tank. However, the operation fluid may be discharged to other places. That is, the fluid tube for discharging the hydraulic fluid may be connected to a portion other than the operation fluid tank. For example, the fluid tube may be connected to the suction portion of the hydraulic pump (the portion for sucking the operation fluid) or to another portion.

In the above-described embodiments, the control valve is constituted of a three-position switching valve. However, the number of switching positions is not limited, and the control valve may be constituted of a two-position switching valve, a four-position switching valve, or another switching valve. In the above-described embodiment, the hydraulic pump is constituted of a constant displacement pump. However, the hydraulic pump may be constituted of a variable displacement pump whose discharge amount is changed by movement of the swash plate, or may be constituted of another hydraulic pump, for example.

In addition, the first hydraulic actuator, the second hydraulic actuator, the third hydraulic actuator, the first control valve, the second control valve, and the third control valve are not limited to the configurations of the above-described embodiment, and may be those provided in the working machine 1.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

The first control valve and the second control valve are not limited to those of the above-described embodiments, and any control valve provided in the working machine may be adopted.

What is claimed is:

1. A hydraulic system for a working machine, comprising:

a hydraulic pump to output an operation fluid;

a first hydraulic actuator;

a second hydraulic actuator;

an operation fluid tank;

a first control valve to control the first hydraulic actuator;

a second control valve to control the second hydraulic actuator, the second control valve being arranged on a downstream side of the first control valve;

a first discharge fluid tube connected between a discharge port of to any one of the first control valve and the operation fluid tank;

a pressure increasing portion connected to the first discharge fluid tube, and configured to increase pressure of the operation fluid in the first discharge fluid tube;

a float switching valve having an allowance position, a prevention position, and a float position; and a second discharge fluid tube branched from the first discharge fluid tube to include one fluid tube connected to the float switching valve and another fluid tube connected between the float switching valve and the operation fluid tank, and configured to discharge the operation fluid separately from the first discharge fluid tube, wherein the float switching valve is configured to in the allowance position, block the second discharge fluid tube and allow the operation fluid to flow to the pressure increasing portion, in the prevention position, unblock the second discharge fluid tube and prevent the operation fluid from flowing to the pressure increasing portion, and in the float position, allow the operation fluid of the first hydraulic actuator to be discharged from a third discharge fluid tube other than the first discharge fluid tube and the second discharge fluid tube.

2. A hydraulic system for a working machine, comprising:

a hydraulic pump to output an operation fluid;

a first hydraulic actuator;

a second hydraulic actuator;

a first control valve to control the first hydraulic actuator;

a second control valve to control the second hydraulic actuator, the second control valve being arranged on a downstream side of the first control valve;

a first discharge fluid tube connected to a discharge port of the first control valve;

a pressure increasing portion connected to the first discharge fluid tube, and configured to increase pressure of the operation fluid in the first discharge fluid tube;

a second discharge fluid tube connected to the first discharge fluid tube and configured to discharge the operation fluid separately from the first discharge fluid tube;

a float switching valve having an allowance position, a prevention position, and a float position, the allowance position blocking the second discharge fluid tube and allowing the operation fluid to flow to the pressure increasing portion, the prevention position unblocking the second discharge fluid tube and preventing the operation fluid from flowing to the pressure increasing portion, and the float position allowing the operation fluid of the first hydraulic actuator to be discharged from a third discharge fluid tube other than the first discharge fluid tube and the second discharge fluid tube;

an output fluid tube coupling the first control valve to the hydraulic pump; and an unload fluid tube branched from the output fluid tube and connected to the float switching valve, wherein the float switching valve has an unload position allowing the operation fluid of the unload fluid tube to be discharged to the second discharge fluid tube.

3. The hydraulic system according to claim 2, comprising an operation member having a lever to operate at least one of the first hydraulic actuator and the second hydraulic actuator, wherein the float switching valve is configured to be switched to the unload position when both of the first hydraulic actuator and the second hydraulic actuator are not operated by the operation member.

4. The hydraulic system according to claim 3, wherein the float switching valve is configured to be switched to any one of the prevention position, the allowance position, and the float position when any one of the first hydraulic actuator and the second hydraulic actuator is operated by the operation member.

5. The hydraulic system according to claim 2, comprising:

a first fluid tube in which a return fluid that is the operation fluid returning from the first hydraulic actuator to the first control valve flows toward the second control valve;

a second fluid tube in which a supply fluid that is the operation fluid supplied from the discharge fluid tube to the first control valve flows toward the first hydraulic actuator;

a third fluid tube coupling the first fluid tube to the first discharge fluid tube and being communicated with a discharge port inside the first control valve; and a fourth fluid tube connected to the first fluid tube and configured to return, to the second fluid tube, the return fluid from the first fluid tube.

6. The hydraulic system according to claim 5, wherein the first fluid tube includes:

a first coupling fluid tube in which the return fluid flows, the first coupling fluid tube coupling the first control valve to the first hydraulic actuator;

a first inner fluid tube arranged in the first control valve and communicated with the first coupling fluid tube; and an outer fluid tube communicated with the first inner fluid tube, the outer fluid tube coupling the first control valve to the second control valve, wherein the second fluid tube includes:

a second coupling fluid tube in which the supply fluid flows, the second coupling fluid tube coupling the first control valve to the first hydraulic actuator; and a second inner fluid tube arranged in the first control valve and communicated with the second coupling fluid tube, and wherein the third fluid tube couples the first inner fluid tube to the first discharge fluid tube.

7. The hydraulic system according to claim 6, wherein the fourth fluid tube includes:

a coupling fluid tube other than the first fluid tube, the coupling fluid tube coupling the first control valve to the outer fluid tube of the first fluid tube;

a third inner fluid tube arranged in the first control valve and communicated with the coupling fluid tube; and a return fluid tube to return, to the first control valve, the operation fluid having passed through the coupling fluid tube and the third inner fluid tube, the return fluid tube being communicated with the third inner fluid tube.

* * * * *